US009327170B2

(12) United States Patent
Solheim et al.

(10) Patent No.: US 9,327,170 B2
(45) Date of Patent: May 3, 2016

(54) GOLF CLUBS WITH HOSEL INSERTS AND RELATED METHODS

(71) Applicant: Karsten Manufacturing Corporation, Phoenix, AZ (US)

(72) Inventors: John A. Solheim, Phoenix, AZ (US); Eric V. Cole, Phoenix, AZ (US); Jeffrey A. Blankenship, Phoenix, AZ (US); Eric J. Morales, Laveen, AZ (US); Ryan M. Stokke, Scottsdale, AZ (US); Martin R. Jertson, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 14/282,786

(22) Filed: May 20, 2014

(65) Prior Publication Data

US 2014/0370999 A1 Dec. 18, 2014

Related U.S. Application Data

(63) Continuation-in-part of application No. 13/795,653, filed on Mar. 12, 2013, now Pat. No. 9,168,426, and a continuation-in-part of application No. 13/429,319, filed on Mar. 24, 2012, now Pat. No. 8,790,191, and a continuation-in-part of application No. 13/468,663, filed on May 10, 2012, now Pat. No. 8,926,447, and a continuation-in-part of application No. 13/468,675, filed on May 10, 2012, now Pat. No. 8,932,147, and a continuation-in-part of application No. 13/735,123, filed on Jan. 7, 2013, now Pat. No. 9,192,823, said (Continued)

(51) Int. Cl.
*A63B 53/02* (2015.01)
*A63B 53/04* (2015.01)

(52) U.S. Cl.
CPC ..... *A63B 53/02* (2013.01); *A63B 53/0466* (2013.01); *A63B 2053/023* (2013.01); *Y10T 29/49826* (2015.01)

(58) Field of Classification Search
CPC ..... A63B 53/0466; A63B 53/02; A63B 2053/023; A63B 2053/022; A63B 2053/027; Y10T 29/49826
See application file for complete search history.

(56) References Cited

U.S. PATENT DOCUMENTS

| | | | |
|---|---|---|---|
| 1,540,559 | A | 6/1925 | Murphy |
| 1,610,802 | A | 12/1926 | McNair |
| 1,623,523 | A | 4/1927 | Bourke |
| 1,665,811 | A | 4/1928 | Hadden |
| 1,918,583 | A | 7/1933 | Bear |
| 2,027,452 | A | 1/1936 | Rusing |
| 2,051,961 | A | 8/1936 | Mears |
| 2,067,556 | A | 1/1937 | Wettlaaufer |
| 2,175,598 | A | 10/1939 | Fedak |
| 2,219,670 | A | 10/1940 | Wettlaufer |
| 2,425,808 | A | 8/1947 | Jakosky |
| 2,644,689 | A | 7/1953 | Putnam |
| 2,962,286 | A | 11/1960 | Brouwer |
| 3,170,691 | A | 2/1965 | Pritchard |
| 3,176,987 | A | 4/1965 | Johnston |
| 3,206,206 | A | 9/1965 | Santosuosso |
| 3,524,646 | A | 8/1970 | Wheeler |
| 3,601,399 | A | 8/1971 | Agens et al. |

(Continued)

FOREIGN PATENT DOCUMENTS

| | | |
|---|---|---|
| EP | 0535848 | 4/1993 |
| GB | 2241173 | 8/1991 |

(Continued)

*Primary Examiner* — Stephen Blau

(57) ABSTRACT

Embodiments of golf clubs with hosel inserts are presented herein. Other examples and related methods are also disclosed herein.

25 Claims, 12 Drawing Sheets

Related U.S. Application Data application No. 13/468,663 is a continuation-in-part of application No. 13/429,319, said application No. 13/468,675 is a continuation-in-part of application No. 13/429,319, said application No. 13/735,123 is a continuation-in-part of application No. 13/468,663, and a continuation-in-part of application No. 13/468,675, and a continuation-in-part of application No. 13/468,677, filed on May 10, 2012, now Pat. No. 8,419,567, which is a continuation of application No. 13/429,319.

(60) Provisional application No. 61/590,232, filed on Jan. 24, 2012, provisional application No. 61/529,880, filed on Aug. 31, 2011.

(56) References Cited

U.S. PATENT DOCUMENTS 3,625,513 A 12/1971 Ballmer
3,685,135 A 8/1972 Letters
3,840,231 A 10/1974 Moore
3,907,446 A 9/1975 Leslie
4,664,382 A 5/1987 Palmer et al.
4,815,740 A 3/1989 Williams et al.
4,852,782 A 8/1989 Wu et al.
4,854,582 A 8/1989 Yamada
4,892,316 A 1/1990 Langert et al.
4,943,059 A 7/1990 Morell
4,948,132 A 8/1990 Wharton
4,995,609 A 2/1991 Parente et al.
5,039,098 A 8/1991 Pelz
5,042,806 A 8/1991 Helmstetter
5,067,711 A 11/1991 Parente et al.
5,149,091 A 9/1992 Okumoto et al.
5,165,688 A 11/1992 Schmidt et al.
5,222,734 A 6/1993 Parente et al.
5,273,280 A 12/1993 Lo
5,275,399 A 1/1994 Schmidt et al.
5,320,347 A 6/1994 Parente et al.
5,324,033 A 6/1994 Fenton, Jr.
5,395,109 A 3/1995 Fenton, Jr.
5,429,355 A 7/1995 Schmidt et al.
5,433,442 A 7/1995 Walker
5,441,274 A 8/1995 Clay
5,538,245 A 7/1996 Moore
D375,130 S 10/1996 Hlinka et al.
D378,770 S 4/1997 Hlinka et al.
5,632,695 A 5/1997 Hlinka et al.
5,647,807 A 7/1997 Nagamoto
5,722,901 A 3/1998 Barron et al.
D393,678 S 4/1998 Jones et al.
5,839,973 A 11/1998 Jackson
5,863,260 A 1/1999 Butler, Jr. et al.
5,924,938 A 7/1999 Hines
5,935,020 A * 8/1999 Stites ..... A63B 53/04 473/291
5,951,411 A 9/1999 Wood et al.
6,050,903 A 4/2000 Lake
6,077,172 A * 6/2000 Butler ..... A63B 53/02 473/305
D434,822 S 12/2000 Jacobson et al.
D449,665 S 10/2001 Etherton et al.
6,319,148 B1 11/2001 Tom
6,352,482 B1 3/2002 Jacobson et al.
6,547,673 B2 4/2003 Roark
6,634,958 B1 * 10/2003 Kusumoto ..... A63B 53/02 473/310
6,669,576 B1 * 12/2003 Rice ..... A63B 53/02 473/305
6,716,114 B2 4/2004 Nishio
6,857,969 B2 2/2005 Rice
6,863,622 B1 3/2005 Hsu
6,887,163 B2 5/2005 Blankenship
6,890,269 B2 5/2005 Burrow
7,029,402 B2 * 4/2006 Nakajima ..... A63B 53/02 473/309
7,083,529 B2 8/2006 Cackett et al.
7,117,923 B2 10/2006 Schweigert
D537,896 S 3/2007 Holt et al.
7,241,229 B2 * 7/2007 Poyno ..... A63B 53/02 473/309
7,300,359 B2 11/2007 Hocknell et al.
7,326,126 B2 2/2008 Holt et al.
7,344,449 B2 3/2008 Hocknell et al.
7,351,159 B2 4/2008 Lai
7,438,645 B2 10/2008 Hsu
D582,999 S 12/2008 Evans et al.
D583,000 S 12/2008 Evans et al.
D583,001 S 12/2008 Evans et al.
D583,002 S 12/2008 Evans et al.
D583,890 S 12/2008 DeMille et al.
D583,891 S 12/2008 DeMille et al.
7,465,239 B2 12/2008 Hocknell et al.
D586,417 S 2/2009 Hall et al.
D587,770 S 3/2009 Evans et al.
D588,219 S 3/2009 Evans et al.
D588,660 S 3/2009 Evans et al.
D588,663 S 3/2009 Lee
D589,577 S 3/2009 Evans et al.
D590,036 S 4/2009 Evans et al.
D590,466 S 4/2009 Hall et al.
D590,467 S 4/2009 Cackett et al.
D590,468 S 4/2009 Evans et al.
D590,904 S 4/2009 Evans et al.
D590,905 S 4/2009 DeMille et al.
D590,906 S 4/2009 Cackett et al.
D591,375 S 4/2009 Evans et al.
D591,376 S 4/2009 Evans et al.
D591,377 S 4/2009 Evans et al.
D591,378 S 4/2009 Hocknell et al.
D591,380 S 4/2009 Evans et al.
7,530,900 B2 5/2009 Holt et al.
7,553,240 B2 6/2009 Burnett et al.
7,566,279 B2 7/2009 Nakashima
7,578,749 B2 8/2009 Hocknell et al.
7,601,075 B2 10/2009 Cole et al.
D614,712 S 4/2010 Toulon et al.
7,699,717 B2 4/2010 Morris et al.
7,722,475 B2 5/2010 Thomas et al.
7,762,906 B2 * 7/2010 Murphy ..... A63B 53/02 473/309
7,846,037 B2 * 12/2010 Burnett ..... A63B 53/02 473/307
7,874,934 B2 * 1/2011 Soracco ..... A63B 53/02 473/307
7,878,921 B2 2/2011 Bennett et al.
7,909,706 B2 3/2011 Cole
7,922,599 B2 4/2011 Yamamoto
7,931,542 B2 4/2011 Kusumoto
7,955,182 B2 6/2011 Thomas et al.
7,963,855 B2 6/2011 Sander et al.
7,980,959 B2 7/2011 Morris et al.
7,997,997 B2 8/2011 Bennett et al.
8,025,587 B2 9/2011 Beach et al.
8,057,320 B2 11/2011 Bennett et al.
8,079,918 B2 12/2011 Cole
8,088,019 B1 1/2012 Long et al.
8,096,894 B2 1/2012 Sander
8,133,131 B1 3/2012 Bennett et al.
8,142,306 B2 3/2012 De La Cruz et al.
8,147,350 B2 4/2012 Beach et al.
8,147,351 B2 4/2012 Bennett et al.
8,177,661 B2 * 5/2012 Beach ..... A63B 53/02 473/307
8,207,507 B2 6/2012 Zaitseva et al.
8,216,084 B2 7/2012 Bennett et al.
8,231,480 B2 7/2012 Thomas et al.
8,235,834 B2 8/2012 De La Cruz et al.
8,235,837 B2 8/2012 Bennett et al.
8,262,498 B2 9/2012 Beach et al.
8,277,333 B2 10/2012 Thomas et al.
8,303,431 B2 11/2012 Beach et al.
8,403,770 B1 3/2013 Aguinaldo et al.

(56) References Cited

U.S. PATENT DOCUMENTS

| | | | | |
|---|---|---|---|---|
| 8,419,567 | B2 | 4/2013 | Jertson et al. | |
| 8,496,541 | B2 | 7/2013 | Beach et al. | |
| 8,523,701 | B2 | 9/2013 | Knutson et al. | |
| 8,535,173 | B2 | 9/2013 | Golden et al. | |
| 8,602,907 | B2 | 12/2013 | Beach et al. | |
| 8,616,995 | B2 | 12/2013 | Thomas et al. | |
| 8,622,847 | B2 | 1/2014 | Beach et al. | |
| 8,636,606 | B2 | 1/2014 | Sato | |
| 8,696,487 | B2 | 4/2014 | Beach et al. | |
| 2001/0007835 | A1 | 7/2001 | Baron | |
| 2005/0059508 | A1 | 3/2005 | Burnett et al. | |
| 2005/0101402 | A1 | 5/2005 | Kawakami | |
| 2005/0239576 | A1 | 10/2005 | Stites et al. | |
| 2005/0282653 | A1 | 12/2005 | Murphy et al. | |
| 2006/0281575 | A1 | 12/2006 | Hocknell et al. | |
| 2006/0287125 | A1 | 12/2006 | Hocknell et al. | |
| 2006/0293115 | A1 | 12/2006 | Hocknell et al. | |
| 2006/0293116 | A1 | 12/2006 | Hocknell et al. | |
| 2007/0117645 | A1* | 5/2007 | Nakashima | A63B 53/02 473/288 |
| 2008/0058114 | A1 | 3/2008 | Hocknell et al. | |
| 2008/0254909 | A1 | 10/2008 | Callinan et al. | |
| 2008/0261716 | A1 | 10/2008 | Sugimoto | |
| 2008/0280693 | A1* | 11/2008 | Chai | A63B 53/02 473/288 |
| 2008/0293510 | A1 | 11/2008 | Yamamoto | |
| 2009/0062029 | A1 | 3/2009 | Stites et al. | |
| 2009/0075749 | A1 | 3/2009 | De La Cruz et al. | |
| 2009/0124407 | A1 | 5/2009 | Hocknell et al. | |
| 2009/0197698 | A1 | 8/2009 | Morris et al. | |
| 2009/0233728 | A1 | 9/2009 | Liou | |
| 2009/0247316 | A1 | 10/2009 | De La Cruz et al. | |
| 2009/0264214 | A1 | 10/2009 | De La Cruz et al. | |
| 2009/0275423 | A1 | 11/2009 | Yamamoto | |
| 2009/0286611 | A1 | 11/2009 | Beach et al. | |
| 2009/0286618 | A1 | 11/2009 | Beach et al. | |
| 2009/0286619 | A1 | 11/2009 | Beach et al. | |
| 2010/0016094 | A1 | 1/2010 | Hocknell et al. | |
| 2010/0016096 | A1 | 1/2010 | Burnett et al. | |
| 2010/0035700 | A1 | 2/2010 | Yu et al. | |
| 2010/0035701 | A1 | 2/2010 | Kusumoto | |
| 2010/0041491 | A1 | 2/2010 | Thomas et al. | |
| 2010/0120550 | A1 | 5/2010 | Galloway | |
| 2010/0120552 | A1 | 5/2010 | Sander et al. | |
| 2010/0144459 | A1 | 6/2010 | Sato et al. | |
| 2010/0197423 | A1 | 8/2010 | Thomas et al. | |
| 2010/0197424 | A1 | 8/2010 | Beach et al. | |
| 2010/0203981 | A1 | 8/2010 | Morris et al. | |
| 2010/0261543 | A1 | 10/2010 | Breier et al. | |
| 2010/0323808 | A1 | 12/2010 | Sato et al. | |
| 2010/0323809 | A1 | 12/2010 | Murphy | |
| 2010/0331121 | A1 | 12/2010 | Morris et al. | |
| 2011/0009206 | A1 | 1/2011 | Soracco | |
| 2011/0021282 | A1 | 1/2011 | Sander | |
| 2011/0098127 | A1 | 4/2011 | Yamamoto | |
| 2011/0105242 | A1 | 5/2011 | Beach et al. | |
| 2011/0111881 | A1 | 5/2011 | Sander et al. | |
| 2011/0118044 | A1 | 5/2011 | Sato et al. | |
| 2011/0118045 | A1 | 5/2011 | Sato et al. | |
| 2011/0118048 | A1 | 5/2011 | Soracco | |
| 2011/0118051 | A1 | 5/2011 | Thomas | |
| 2011/0143854 | A1 | 6/2011 | Bennett et al. | |
| 2011/0152000 | A1 | 6/2011 | Sargent et al. | |
| 2011/0159983 | A1 | 6/2011 | Burnett et al. | |
| 2011/0177876 | A1 | 7/2011 | Bennett et al. | |
| 2011/0190072 | A1 | 8/2011 | Beach et al. | |
| 2011/0195798 | A1 | 8/2011 | Sander et al. | |
| 2011/0201447 | A1 | 8/2011 | Thomas et al. | |
| 2011/0207547 | A1 | 8/2011 | Sander et al. | |
| 2011/0250984 | A1 | 10/2011 | Sato | |
| 2011/0275448 | A1 | 11/2011 | Morris et al. | |
| 2011/0287853 | A1 | 11/2011 | Sato | |
| 2011/0312437 | A1 | 12/2011 | Sargent et al. | |
| 2011/0319185 | A1 | 12/2011 | Beach et al. | |
| 2012/0010015 | A1 | 1/2012 | Bennett et al. | |
| 2012/0034994 | A1 | 2/2012 | Knutson et al. | |
| 2012/0034995 | A1 | 2/2012 | Harvell et al. | |
| 2012/0034996 | A1* | 2/2012 | Murphy | A63B 53/02 473/307 |
| 2012/0071261 | A1* | 3/2012 | Yamamoto | A63B 53/02 473/307 |
| 2012/0100926 | A1 | 4/2012 | Golden et al. | |
| 2012/0165111 | A1 | 6/2012 | Cheng | |
| 2012/0165112 | A1 | 6/2012 | Bennett et al. | |
| 2012/0225731 | A1 | 9/2012 | Suwa et al. | |
| 2012/0316006 | A1 | 12/2012 | Kitagawa et al. | |
| 2013/0053164 | A1 | 2/2013 | Jertson et al. | |
| 2013/0053167 | A1 | 2/2013 | Jertson et al. | |
| 2013/0085010 | A1 | 4/2013 | Beach et al. | |
| 2013/0296069 | A1 | 11/2013 | Beach et al. | |
| 2013/0324285 | A1 | 12/2013 | Beach et al. | |
| 2014/0066223 | A1 | 3/2014 | Beach et al. | |
| 2014/0080617 | A1* | 3/2014 | Llewellyn | A63B 53/02 473/246 |
| 2014/0106900 | A1* | 4/2014 | Beach | A63B 53/02 473/335 |
| 2014/0113740 | A1 | 4/2014 | Stites et al. | |

FOREIGN PATENT DOCUMENTS

| | | | | |
|---|---|---|---|---|
| GB | 2363340 | | 12/2001 | |
| GB | 2387550 | | 10/2003 | |
| JP | 7-255880 | * | 10/1995 | A63B 53/02 |
| JP | 7-328150 | * | 12/1995 | A63B 53/02 |
| JP | 2001017584 | | 1/2001 | |
| JP | 2003070940 | | 3/2003 | |
| JP | 2006042951 | | 2/2006 | |
| JP | 2009050676 | | 3/2009 | |
| JP | 3154639 | | 10/2009 | |
| KR | 20070021382 | | 2/2007 | |
| WO | 8803427 | | 5/1988 | |
| WO | 2007021160 | | 2/2007 | |
| WO | 2009035345 | | 3/2009 | |
| WO | 2010039658 | | 4/2010 | |
| WO | 2011048969 | | 4/2011 | |

* cited by examiner

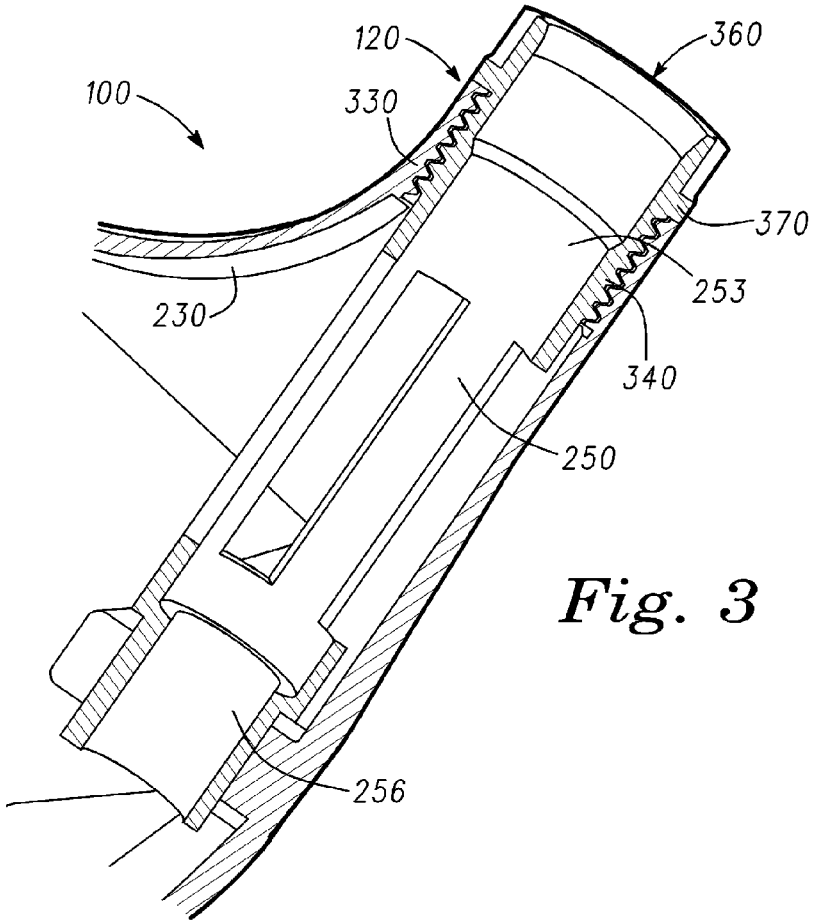
Fig. 3
Fig. 4
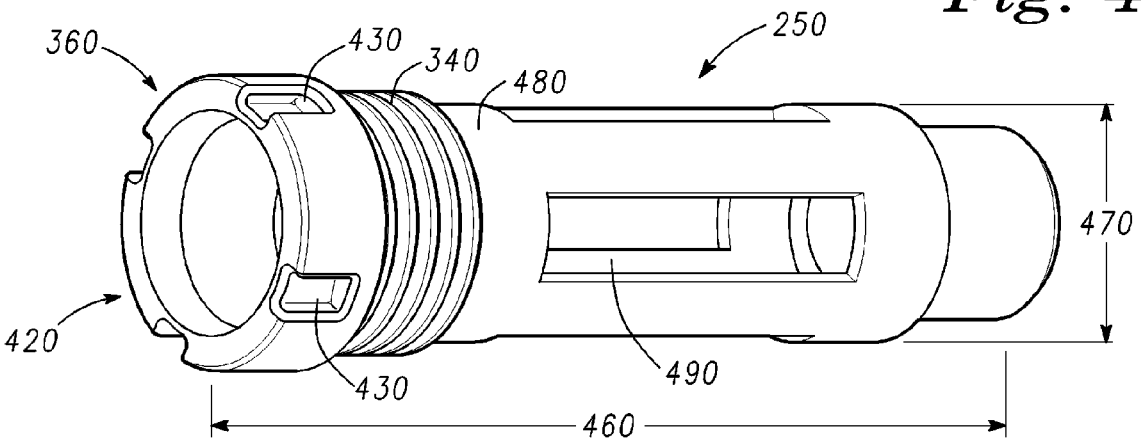

GOLF CLUBS WITH HOSEL INSERTS AND RELATED METHODS

CLAIM OF PRIORITY

This application is a continuation in part of U.S. patent application Ser. No. 13/795,653, filed on Mar. 12, 2013. Also, this application also is a continuation in part of: (i) U.S. patent application Ser. No. 13/429,319, filed on Mar. 24, 2012, (ii) U.S. patent application Ser. No. 13/468,663, filed on May 10, 2012, (iii) U.S. patent application Ser. No. 13/468,675, filed on May 10, 2012, and (iv) U.S. patent application Ser. No. 13/735,123, filed on Jan. 7, 2013.

Meanwhile, U.S. patent application Ser. No. 13/429,319 claims the benefit of U.S. Provisional Patent Application No. 61/590,232, filed on Jan. 24, 2012, and of U.S. Provisional Patent Application No. 61/529,880, filed on Aug. 31, 2011. Further, U.S. patent application Ser. No. 13/468,663 and U.S. patent application Ser. No. 13/468,675 each are a continuation in part of U.S. patent application Ser. No. 13/429,319. Likewise, U.S. patent application Ser. No. 13/735,123 is a continuation in part of: (i) U.S. patent application Ser. No. 13/468,663 (ii) U.S. patent application Ser. No. 13/468,675, and (iii) U.S. patent application Ser. No. 13/468,677, filed on May 10, 2012 and which issued as U.S. Pat. No. 8,419,567 on Apr. 16, 2013. U.S. patent application Ser. No. 13/468,677 is a continuation of U.S. patent application Ser. No. 13/429,319.

U.S. patent application Ser. Nos. 13/795,653, 13/429,319, 13/468,663, 13/468,675, 13/735,123, 13/468,677, U.S. Provisional Patent Application No. 61/590,232, and U.S. Provisional Patent Application No. 61/529,880 each are incorporated herein by reference.

TECHNICAL FIELD

The present disclosure relates generally to golf equipment, and more particularly, to golf clubs with hosel inserts and related methods.

BACKGROUND

Golf club heads have been progressively growing in volume and size throughout the years in an effort to improve the game experience. As the golf club heads have grown in volume, the mass of the golf clubs has also increased Innovation in mass distribution has been a major focus of the golf industry, and utilizing various materials to achieve desirable characteristics has become increasingly common.

A golf club head's design can optimize the golf club head's mass distribution scheme by, for example, using less dense materials in certain areas and more dense materials in other areas. Such designs can facilitate a larger golf club head without compromising performance.

BRIEF DESCRIPTION OF THE DRAWINGS

The present disclosure can be better understood from a reading of the following detailed description of examples of embodiments, taken in conjunction with the accompanying figures.

FIG. 3 is a cross sectional view of a hosel region of the golf club head of FIG. 1.

FIG. 4 is a side view of a hosel insert according to the embodiment of FIG. 2.

Figure 1:
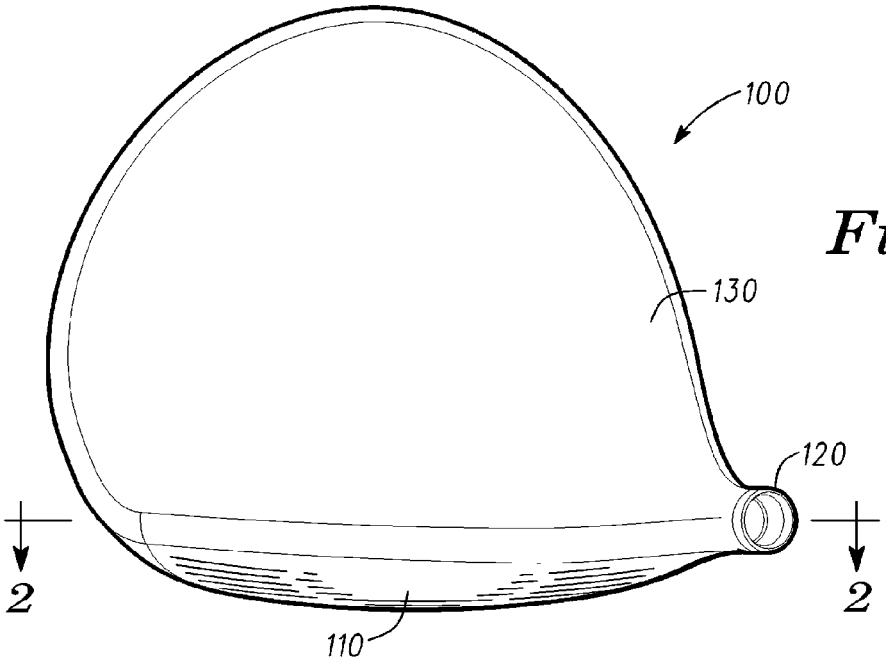
FIG. 1 is a top view of a golf club head according to one embodiment of the apparatus, methods and articles of manufacture described herein.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements, mechanically or otherwise. Coupling (whether mechanical or otherwise) may be for any length of time, e.g., permanent or semi-permanent or only for an instant.

The absence of the word "removably," "removable," and the like near the word "coupled," and the like does not mean that the coupling, etc. in question is or is not removable.

As defined herein, two or more elements are "integral" if they are comprised of the same piece of material. As defined herein, two or more elements are "non-integral" if each is comprised of a different piece of material.

DESCRIPTION

Some examples include a golf club. The golf club can comprise golf club head with a strike face and a hole. The golf club head can comprise a first material that has a first density. A hosel insert can be located within the hole and the hosel insert can comprise a second material having a second density. The second material can be different from the first material, and the second density can be less than the first density. A shaft can have a shaft tip that can be located within a portion of the hosel insert.

Other examples include a golf club head. The golf club head can comprise a hollow body made of a first material. The golf club head can have a strike face, and a crown that is coupled to the strike face comprising a crown hole that opens into the interior of the hollow body. The golf club also has a sole coupled to the strike face, an interior surface. The interior surface forms an outer boundary of the interior of the hollow body. The golf club head also has a support structure that is coupled to the interior surface and aligned with the crown hole. A hosel comprising a first hosel portion configured to house a shaft tip, and a second hosel portion adjacent to the first hosel portion. Wherein the first hosel portion engages the crown hole, and the second hosel portion engages the support structure. The hosel comprising a second material different form the first material.

Further examples include a method for providing a golf club. The method can include providing a golf club head comprising a strike face and a hole. The golf club head comprising a first material having a first density. Further, the method can include positioning a hosel insert within the hole and comprising a second material have a second density. The second material different form the first material, and the second density different from the first density. Further still, the method can include positioning a shaft within a portion of the hosel insert.

Meanwhile, some examples include a golf club head. The golf club head can comprise an exterior head surface comprising a strike face, an exterior crown surface, and an exterior sole surface. The exterior crown surface can be coupled to the strike face. Also, the exterior crown surface can comprise an exterior hosel surface, and the exterior hosel surface can comprise a top opening that provides access to an interior head volume of the golf club head. Meanwhile, the exterior sole surface can be coupled to the strike face and opposite the exterior crown surface. Further, the golf club head can comprise an interior head surface opposite the exterior head surface and defining the interior head volume and a receiver located within the interior head volume. The receiver can comprise a receiver hosel structure adjacent to the top opening and defined at least in part by the interior head surface opposite the exterior hosel surface. Also, the receiver can comprise a receiver lower structure separated by the interior head volume from the receiver hosel structure. In these examples, a majority of a top end of the receiver lower structure can be exposed to a majority of the interior head volume, and the majority of the top end of the receiver lower structure can be decoupled from the receiver hosel structure.

Other examples include a golf club head. The golf club head can comprise an exterior head surface comprising a strike face, an exterior crown surface, and an exterior sole surface. The exterior crown surface can be coupled to the strike face. Also, the exterior crown surface can comprise an exterior hosel surface, and the exterior hosel surface can comprise a top opening that provides access to an interior head volume of the golf club head. Meanwhile, the exterior sole surface can be coupled to the strike face and opposite the exterior crown surface. Further, the golf club head can comprise an interior head surface opposite the exterior head surface and defining the interior head volume and a receiver located within the interior head volume. The receiver can comprise a receiver hosel structure adjacent to the top opening and defined at least in part by the interior head surface opposite the exterior hosel surface. Also, the receiver can comprise a receiver lower structure separated by the interior head volume from the receiver hosel structure. In these examples, at least 25% of a top perimeter of the receiver lower structure can be decoupled from a bottom perimeter of the receiver hosel structure.

Further examples include a method for providing a golf club head. The method can comprise providing an exterior head surface. The exterior head surface can comprise a strike face, an exterior crown surface, and an exterior sole surface. The exterior crown surface can be coupled to the strike face. Also, the exterior crown surface can comprise an exterior hosel surface, and the exterior hosel surface can comprise a top opening that provides access to an interior head volume of the golf club head. Meanwhile, the exterior sole surface can be coupled to the strike face and opposite the exterior crown surface. Further, the method can comprise providing an interior head surface opposite the exterior head surface and defining the interior head volume, and providing a receiver located within the interior head volume. The receiver can comprise a receiver hosel structure adjacent to the top opening and defined at least in part by the interior head surface opposite the exterior hosel surface. Also, the receiver can comprise a receiver lower structure separated by the interior head volume from the receiver hosel structure. Meanwhile, providing the receiver can comprises at least one of: providing a majority of a top end of the receiver lower structure exposed to the interior head volume; providing the majority of the top end of the receiver lower structure decoupled from the receiver hosel structure; or providing at least 25% of a top perimeter of the receiver lower structure decoupled from a bottom perimeter of the receiver hosel structure.

Other examples and embodiments are further disclosed herein. Such examples and embodiments are found in the following paragraphs, the figures, and the claims.

FIG. 1 shows a golf club head 100 according to an embodiment. Golf club head 100 is merely exemplary and is not limited to the embodiments presented herein. Golf club head 100 can be employed in many different embodiments or examples not specifically depicted or described herein.

Golf club head 100 is comprised of a strike face 110, a hole 120, and a crown portion 130. Strike face 110 can be configured for striking a golf ball (not shown) and can comprise titanium, steel, aluminum or any other suitable material. Hole 120 can have any shape or diameter. For example, hole 120 can have a generally closed, circular shape with a diameter between approximately 0.25 inches (0.64 centimeters (cm)) and approximately 0.75 inches (1.91 cm). In other embodiments, hole 120 can have a diameter between approximately 0.4 inches (1.0 cm) and approximately 0.6 inches (1.52 cm). In further embodiments, hole 120 can have a partially open circular periphery or any non-circular closed or partially open periphery.

While FIG. 1 depicts hole 120 as being located in crown portion 130 of golf club head 100, hole 120 can be located anywhere on golf club head 100. Further, while FIG. 1 depicts a wood-style golf club head, golf club head 100 can be any one of an iron-style, putter-style, hybrid-style, or wedge-style golf club head.

Golf club head 100 can be manufactured out of any material known in the art. For example titanium, aluminum, various metallic alloys, steel, composites, plastics, wood, or any other sturdy material can make up the majority of golf club head 100. The material used for golf club head 100 has a density value. For example, if golf club head 100 is made of titanium, the titanium can have a density of approximately 4.51 grams per centimeter-cubed ($g/cm^3$) near room temperature, and if golf club head 100 is made of aluminum, the aluminum can have a density of approximately 2.7 $g/cm^3$ near room temperature. In other embodiments, the density of materials used for golf club head 100 can be between approximately 2.6 $g/cm^3$ and approximately 7.8 $g/cm^3$.

Figure 2:
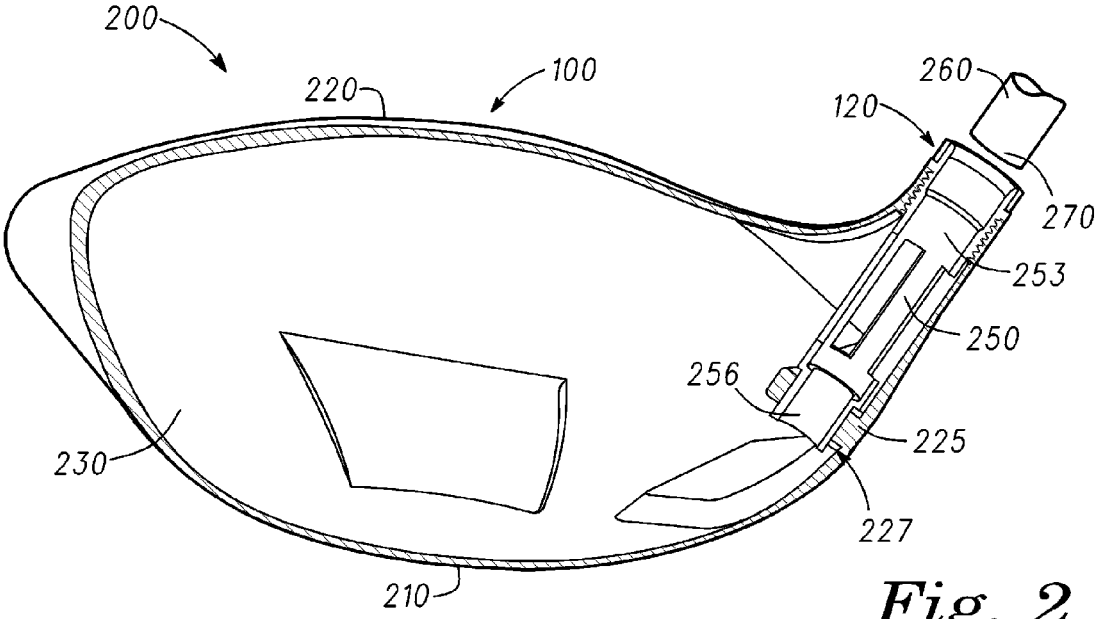
FIG. 2 is a front cross sectional view of a golf club head taken along section line 2-2 according to one embodiment of the apparatus, methods, and articles of manufacture described herein.

FIG. 2 shows a cross section of a golf club 200 that can comprise golf club head 100 depicted in FIG. 1, where the cross section is taken along section line 2-2 in FIG. 1. Golf club 200 is merely exemplary and is not limited to the embodiments presented herein. Golf club 200 can be employed in many different embodiments or examples not specifically depicted or described herein.

Golf club 200 is comprised of golf club head 100 and shaft 260. In FIG. 2, shaft 260 is shown disassembled from golf club head 100. Golf club head 100 is shown to include a sole portion 210, a crown portion 220, an interior surface 230, a support structure 225, and a hosel insert 250. (Hosel insert 250 and shaft 260 are not shown in FIG. 1.) Interior surface 230 defines an outer boundary of a hollow cavity within golf club head 100. Hole 120 can create a passage through interior surface 230 to the interior of golf club head 100. The location on golf club head 100 of hole 120 is not restricted by the embodiment in FIG. 2. Hole 120 can be located anywhere on golf club head 100, leading into the area encompassed by interior surface 230.

Hosel insert 250 is located within hole 120 of golf club head 100. Hosel insert 250 can receive shaft tip 270. Shaft tip 270 can be fixed to the hosel insert 250 by any one of welding, brazing, adhesion, or any mechanical, chemical, or other suitable attachment method. Hosel insert 250 is located in hole 120 to couple shaft 260 to golf club head 100.

Hosel insert 250 can comprise a sturdy material such as magnesium, plastic, composite, or any other suitable material. The material used to manufacture hosel 250 has a density. For example, when hosel 250 is made of magnesium, the magnesium can have a density of 1.73 $g/cm^3$ at room temperature. In other embodiments, these densities can be between approximately 1.0 $g/cm^3$ and approximately 2.8 $g/cm^3$. These densities for the materials of hosel 250 are generally less than the densities of titanium, aluminum, or steel, etc. used to manufacture the rest of golf club head 100. In general, materials with lower density, such as magnesium versus other metals, will have less mass for the same amount of volume. By manufacturing hosel 250 out of a material with a lower density than the other material of golf club head 100, mass can be reduced in the portion of the golf club head where shaft 260 is coupled to golf club head 100. The amount of mass reduced in this portion of golf club head 100 can be added advantageously in other parts of golf club head 100.

In general, hosel insert 250 is located in hole 120 and extends to support structure 225. Hosel insert 250 can be fixed to either hole 120 or support structure 225, or hosel insert 250 can be fixed to both of hole 120 and support structure 225. The fixing methods can be mechanical, chemical, welding, brazing, etc., as described above.

Support structure 225 is located at interior surface 230 of golf club head 100, and is aligned with hole 120. Support structure 225 can comprise a boss-like structure with a support structure bore 227 that is configured to receive hosel insert 250. In another embodiment, support structure 225 may not have support structure bore 227 so that the hosel insert abuts support structure 225.

In one embodiment, support structure 225 is located between hole 120 and sole portion 210. Support structure 225 can be coupled to interior surface 230 of golf club head 100 by any method. For example, support structure 225 can be coupled to interior surface 230 by welding, brazing, or adhering to interior surface 230, or support structure 225 can be cast with interior surface 230 such that support structure 225 and interior surface 230 are part of a single, integral piece of material. In the current embodiment, support structure 225 is approximately 0.75 inches (1.91 cm) from sole portion 210. However, support structure 225 can be located closer to crown portion 220 than shown in FIG. 2 or more distant from crown portion 220.

Hosel insert 250 can comprise a first hosel portion 253 and a second hosel portion 256. First hosel portion 253 is configured to receive, be received by, and/or be coupled to the tip of a shaft 270. The tip of shaft 270 can be fixed to first hosel portion 253 by any of an adhesive, a weld, a braze, or any mechanical or chemical fastening method. Second hosel portion 256 is adjacent to first hosel portion 253. Second hosel portion 256 is also adjacent shaft tip 270 when shaft tip 270 is received by first hosel portion 253.

Second hosel portion 256 is supported by support structure 225, and first hosel portion 253 may be supported by hole 120. As shown in FIG. 2, support structure 225 is not contiguous with hole 120 to reduce the mass of the structure used to support hosel insert 250. Hosel insert 250 is exposed within the interior cavity of golf club head 100.

Turning to the next figure, FIG. 3 shows a cross sectional view of the hosel region of golf club head 100. Hosel insert 250 substantially occupies hole 120 when placed in hole 120. Hole 120 has a hole cross section, and hosel insert 250 has at least one exterior hosel insert cross section that is substantially similar to hole 120 cross section. The exterior hosel insert cross section can be slightly smaller than the cross section of hole 120 to facilitate receiving hosel insert 250 into hole 120. In some embodiments, there can be a slight space between hosel insert 250 and the perimeter of hole 120 when hosel insert 250 is installed or located in hole 120. The space can be sealed with a filler material. As an example, the distance between the exterior of hosel insert 250 and hole 120 can be approximately 0.012 inches (0.03 cm) to 0.001 inches (0.003 cm).

Hosel insert 250 can be fixed in hole 120 using a mechanical, chemical, or other technique. For example, hole 120 can comprise the first part of a mechanical fastening mechanism. In FIG. 3, hole 120 can have a hole threaded portion 330 at its perimeter. Hole 120 also can comprise a slotted region for receiving a boss (not shown), or a notched area for receiving a pin (not shown). Hole threaded portion 330 shown in FIG. 3 can have any number of threads of any thickness. Hosel insert 250 can have a second, complimentary mechanical fastening mechanism. For example, hosel insert 250 can have a complimentary hosel threaded portion 340 as shown in the FIG. 3 embodiment, or hosel insert 250 can have a boss (not shown) or a pin (not shown). When hosel insert 250 is placed in hole 120, hole threaded portion 330 will receive hosel threaded portion 340 as hosel insert 250 is rotated into position. The mechanical fixing method can be permanent or reversible.

Other methods of fixing hosel insert 250 into hole 120 can be used in addition to, or in place of, the mechanical methods. For example, hosel insert 250 can be fixed to hole 120 by a welding method. In another example, hosel insert 250 can be fixed to hole 120 by brazing. In a further example, an adhesive or epoxy could be used to fix hosel insert 250 to hole 120. Additionally, any of welding, brazing or adhesive could be used in conjunction with any of the mechanical fixing methods described above. Any of the fixing methods can be applied at first hosel region 253 and/or second hosel region 256.

Hosel insert 250 can comprise a hosel end 360, which can comprise a hosel flange 370. Interior surface 230 of golf club head 100 can create a periphery around hole 120 that can be adjacent to hosel flange 370 when hosel insert 250 is located in hole 120. Hosel flange 370 can assist in sealing hole 120 when hosel insert 250 is installed, can act as a stopping mechanism for the mechanical fastener, and/or can create more bonding surface area for a weld, braze or adhesive. Accordingly, hosel flange 370 can have an exterior diameter that is larger than the diameter of hole 120, and hosel flange 370 can be located outside of hole 120.

In FIG. 4, hosel insert 250 is shown to comprise hosel end 360 and mechanical fastening portion 340. The mechanical fastening portion 340 of hosel insert 250 is depicted as threads proximate to hosel end 360. As indicated above, however, mechanical fastening portion 340 can comprise other features such as pins, bosses, or notches, and mechanical fastening portion 340 can be located anywhere along hosel insert 250. Hosel end 360 further comprises a tooled portion 420 for engaging a tool (not shown) in order to secure mechanical fastening portion 340 to hole 120 (FIG. 3) of golf club head 100 (FIG. 3).

In FIG. 4, tooled portion 420 of hosel insert 250 comprises notches 430 proximate to hosel end 360. Notches 430 are configured to receive a tool (not shown), and then facilitate the engagement of mechanical fastening portion 340 to hole 120 (FIG. 3) to fix hosel insert 250 into golf club head 100 (FIG. 3). Notches 430 can be of any configuration, and can be placed anywhere along hosel insert 250. For example, notches 430 can be located proximate hosel end 360, as shown in FIG. 4, and separate from mechanical fastening portion 340. In a different embodiment, notches 430 can be replaced with a single hexagon or other shape depression, and/or notches 430 can be located on an interior surface of hosel insert 250 (not shown).

Hosel insert 250 has a hosel length 460. Hosel length 460 can be between approximately 0.25 inches (0.64 cm) and approximately 3.0 inches (7.62 cm). In a different embodiment, hosel length 460 is between approximately 0.5 inches (1.27 cm) to approximately 2.0 inches (5.08 cm). Depending on the golf club head being manufactured, hosel length 460 can be any suitable length for hosel insert 250. Factors influencing hosel length 460 are the material being used to manufacture hosel insert 250, the type of golf club head being manufactured, other dimensions of hosel insert 250, and/or the method being used to fix hosel insert 250 to the golf club head.

Hosel insert 250 also has at least one hosel outside diameter 470. Hosel outside diameter 470 can be substantially the same as the diameter of hole 120 configured to support hosel insert 250. For example, hosel outside diameter 470 can be between approximately 0.25 inches (0.64 cm) and approximately 0.75 inches (1.91 cm). In a different embodiment, hosel outside diameter 470 can be between approximately 0.25 inches (0.64 cm) to approximately 0.5 inches (1.27 cm) and/or between approximately 0.4 inches (1.02 cm) and approximately 0.6 inches (1.52 cm). Hosel insert 250 is, according to one embodiment, comprised of more than one hosel outside diameter 470. In other embodiments, hosel outside diameter 470 can stay constant throughout hosel length 460.

Hosel insert 250 can comprise any suitable material that has a lower density than the golf club head (e.g., golf club head 100) that is configured to receive hosel insert 250. The material used to manufacture hosel insert 250 also can have a damping capacity associated with it. The damping capacity of a material defines the ability of the material to absorb vibrations and not transmit the vibrations through the material. The damping capacity is given in a percentage that correlates to a percentage of vibrational energy not transferred through a material. For example, a magnesium alloy can have a damping capacity of 5.33 percent (%) when a predetermined vibrational energy is applied, but cast iron can have a damping capacity of 5.0% and aluminum alloy can have a damping capacity of 0.51% when the same vibrational energy is applied. Hosel insert 250 can comprise a material that is associated with a relatively lower damping factor or capacity when compared to the other material(s) used to manufacture the other parts of the golf club head, as described above. The lower damping factor or capacity of hosel insert 250 can create a better feel of the golf club when contacting a golf ball as well as prolong the structural integrity of the golf club head by damping the vibrations resulting from striking the golf ball.

Hosel insert 250 can have openings or voids 490 in non-end portions of the sidewall of hosel surface 480. Voids 490 can facilitate mass removal from hosel insert 250 without compromising the structural integrity of hosel insert 250. Voids 490 can be rectangular as shown in FIG. 4, or voids 490 can have an elliptical shape or any polygon or closed curve configuration. Voids 490 can comprise any combination of the aforementioned void configurations. Voids 490 can be located centrally along hosel length 460 or off-centered along length 460. The quantity of voids and their arrangement in hosel insert 250 can vary from one hosel insert to another. In another embodiment (not shown) hosel insert 250 can be free from any voids in surface 480 at the side wall of hosel insert 250.

Figure 5:
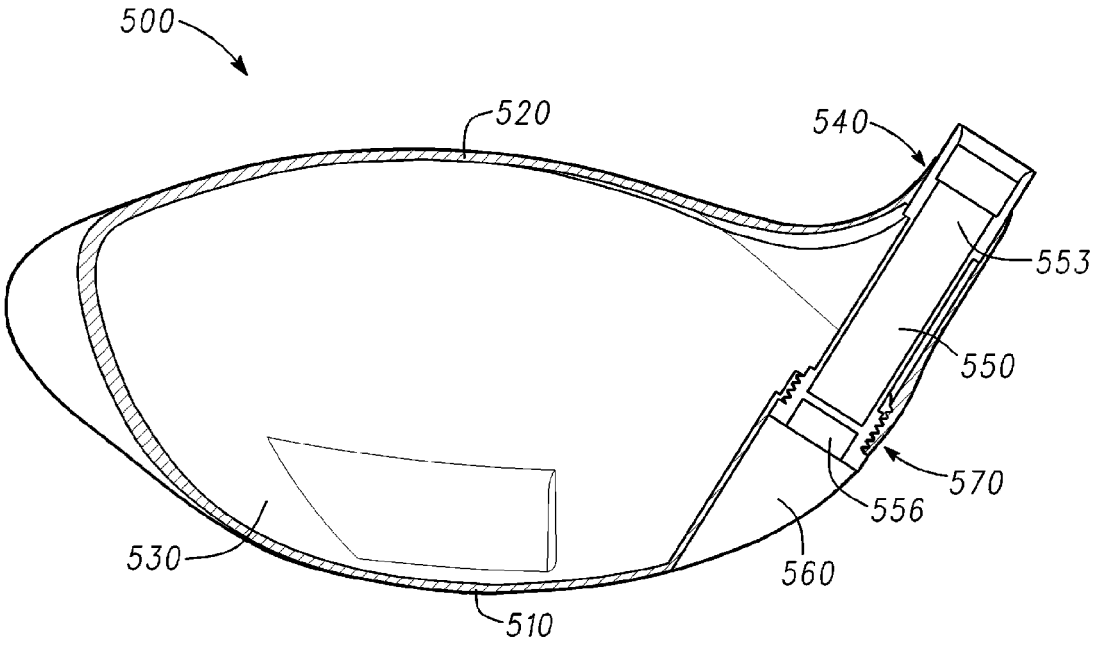
FIG. 5 is a front cross sectional view of a golf club head according to another embodiment of the apparatus, methods, and articles of manufacture described herein.

Referring to FIG. 5, a cross sectional view of a golf club head 500 is shown according to another embodiment. Golf club head 500 is merely exemplary and is not limited to the embodiments presented herein. Golf club head 500 can be employed in many different embodiments or examples not specifically depicted or described herein. Golf club head 500 can be similar to golf club head 100.

Golf club head 500 has a sole portion 510, a crown portion 520, an interior surface 530, a crown hole 540, a hosel insert 550, and a support structure 560. Like the above examples, hosel insert 550 can be located in crown hole 540. Hosel insert 550 can comprise a first hosel portion 553 and a second hosel portion 556. First hosel portion 553 can be supported by crown hole 540, and second hosel portion 556 can be supported by support structure 560. At least one of first hosel portion 553 or second hosel portion 556 is fixed to at least one of crown hole 540 or support structure 560, respectively, using one or more of the fixing methods discussed herein. Hosel insert 550 can have or be devoid of voids (similar to voids 490 in FIG. 4). Also, hosel insert 550 can be exposed inside of golf club head 500.

Support structure 560 comprises a second hole 570 that passes through interior surface 530. Second hole 570 is aligned to crown hole 540 and is located between crown portion 520 and sole portion 510 of golf club head 500. Second hole 570 can be a distance between approximately 0.25 inches (0.64 cm) and approximately 1.5 inches (3.81 cm) from sole portion 510. In one embodiment, second hole 570 can be a distance of approximately 0.75 inches (1.91 cm) from sole portion 510. Second hosel portion 556 can be fixed to second hole 570 by any mechanical, chemical, welding, or brazing, or adhering techniques.

Figure 6:
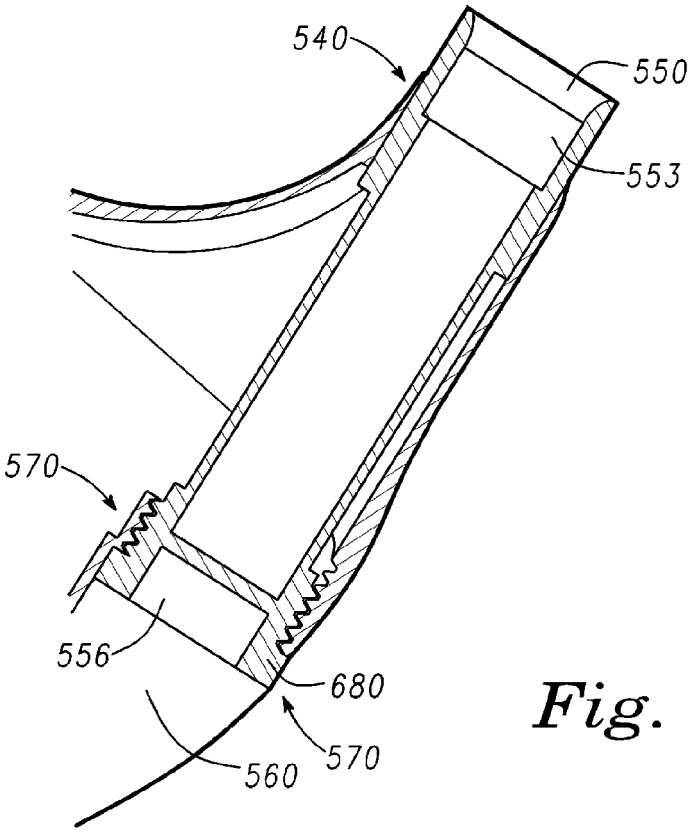
FIG. 6 is a cross sectional view of a hosel region of the golf club head of FIG. 5.

Referring to FIG. 6, a cross sectional view of the hosel region of FIG. 5 is shown. First hosel portion 553 is supported by crown hole 540, and second hosel portion 556 is supported by support structure 560. Second hosel portion 556 can comprise a hosel flange 680 that is adjacent to interior surface 530 and that has an exterior diameter larger than the diameter of second hole 570. Hosel insert 550 can be inserted into second hole 570 until hosel flange 680 abuts second hole 570. Similar to the above embodiments, hosel flange 680 can assist in sealing second hole 570, or hosel flange 680 can act as a stopping mechanism for a mechanical fastener, or hosel flange 680 can create more bonding surface area for a weld, braze or adhesive.

Second hole 570 can comprise any shaped cross section. Second hosel portion 556 can comprise a complimentary cross section such that second hole 570 can be substantially filled by second hosel portion 556. Crown hole 540 and second hole 570 can have the same cross sectional shape and size, and first hosel portion 553 and second hosel portion 556 can have the same cross sectional shape and size. First hosel portion 553 can have a cross section that compliments the cross section of crown hole 540, and second hosel portion 556 can have a cross section that compliments the cross section of second hole 570.

Figure 7:
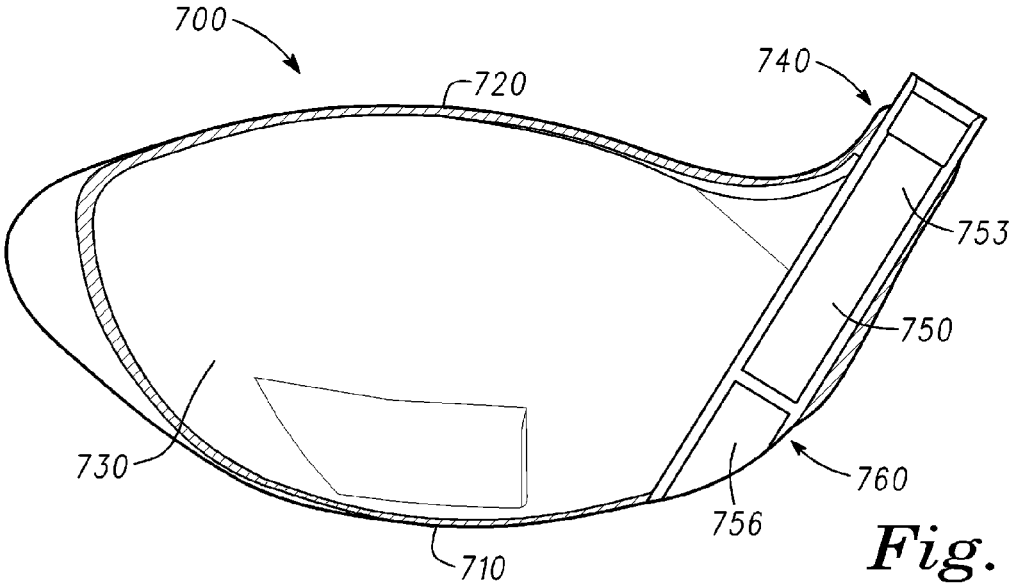
FIG. 7 is a front cross sectional view of a golf club head according to another embodiment of the apparatus, methods, and articles of manufacture described herein.

Turning to FIG. 7, a front cross sectional view of a golf club head 700 is shown according to another embodiment. Golf club head 700 is merely exemplary and is not limited to the embodiments presented herein. Golf club head 700 can be employed in many different embodiments or examples not specifically depicted or described herein. Golf club head 700 can be similar to either of golf club heads 100 (FIGS. 1-3), and/or 500 (FIGS. 5-6).

Golf club head 700 has a sole portion 710, a crown portion 720, an interior surface 730, a crown hole 740, a hosel insert 750, and a sole hole 760. Crown hole 740 and sole hole 760 are passages through interior surface 730 of golf club head 700. Sole hole 760 is aligned with crown hole 740.

Hosel insert 750 is comprised of a first hosel portion 753 and a second hosel portion 756. First hosel portion 753 is configured to receive a shaft tip (not shown), and is supported by crown hole 740. Second hosel portion 756 is adjacent to first hosel portion 753 and the shaft tip (not shown), and is supported by sole hole 760. At least one of first hosel portion 753 or second hosel portion 756 is fixed by one of welding, adhering, brazing, or mechanically fixing to one of crown hole 740 or sole hole 760, respectively. Hosel insert 750 can be exposed inside of golf club head 700.

Figure 8:
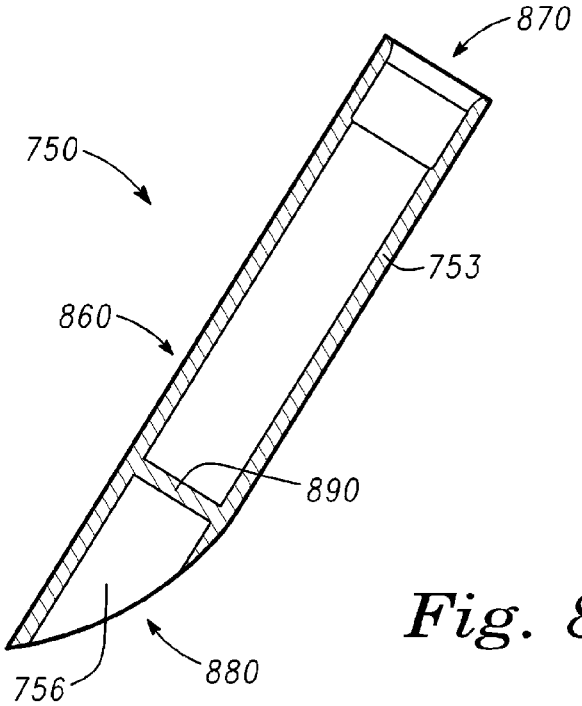
FIG. 8 is a cross sectional view of a hosel insert according to the embodiment of FIG. 7.

FIG. 8 is a cross sectional view of hosel insert 750. Hosel insert 750 can comprise a hollow tubular body 860, a first hosel end 870, a second hosel end 880, and a barrier 890. When placed in golf club head 700 (FIG. 7), first hosel end 870 is proximate crown hole 740 (FIG. 7) of golf club head 700 (FIG. 7), and second hosel end 780 is proximate sole hole 760 (FIG. 7) of golf club head 700 (FIG. 7). Barrier 890 can be located between first hosel end 870 and second hosel end 880. Barrier 890 can abut the shaft tip (not shown) when first hosel portion 753 receives the shaft tip. Additionally, barrier 890 can separate and/or isolate first hosel portion 753 from second hosel portion 756. Hosel insert 750 can have or be devoid of voids (similar to voids 490 in FIG. 4).

Figure 9:
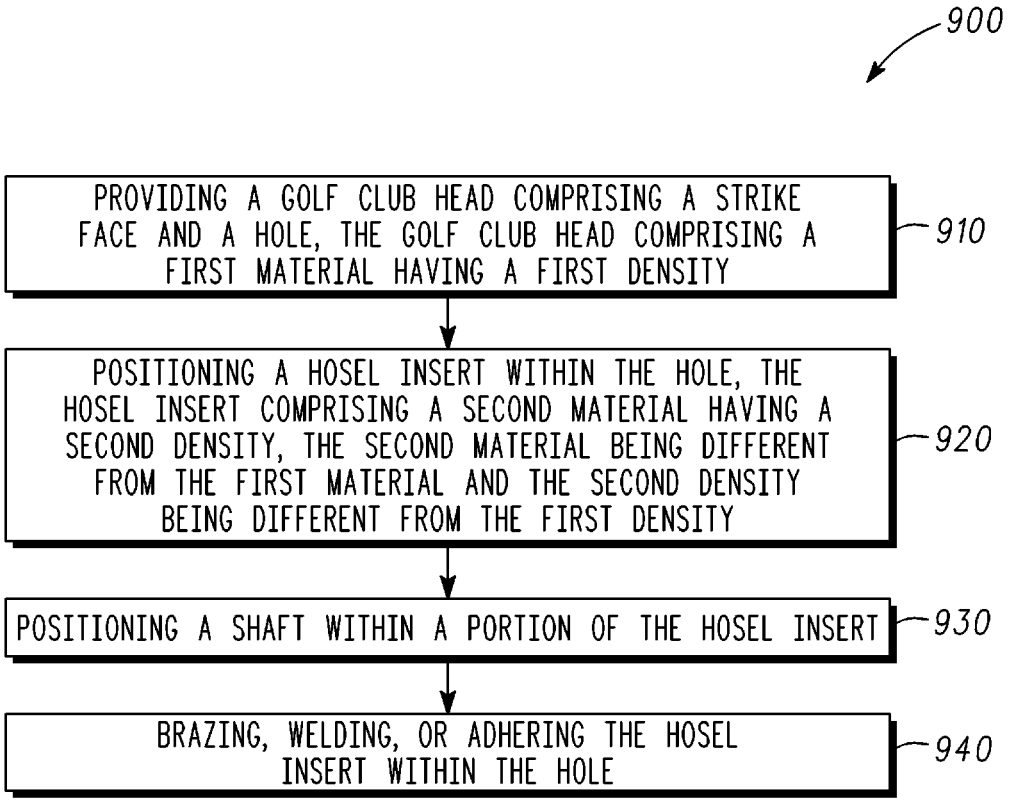
FIG. 9 is a flowchart of a method according to another embodiment.

FIG. 9 illustrates a flowchart for a method 900, which can be used to provide, form, and/or manufacture a golf club head with a hosel insert in accordance with the present disclosure. In some examples, the golf club head with a hosel insert can be similar to the golf club heads and hosel inserts of FIGS. 1-8.

Method 900 can include a block 910 of providing a golf club head comprising a strike face and a hole. The golf club head can comprise a first material having a first density. As an example, the golf club head of block 1310 can be similar to one or more of golf club heads 100 (FIGS. 1-3), 500 (FIGS. 5-6), 700 (FIGS. 7-8).

Method 900 also can include a block 920 of positioning a hosel insert within the hole. The hosel insert can comprise a second material having a second density, where the second material is different form the first material and where the second density is different from the first density. In some embodiments, the second density can be less than the first density. As an example, the hosel insert of block 920 can be similar to one or more of hosel inserts 250 (FIGS. 2-4), 550 (FIG. 5), 750 (FIGS. 7-8).

Method 900 can further include a block 930 for positioning a shaft within a portion of the hosel insert. As an example, the shaft of block 930 can be similar to shaft 260 (FIG. 2). Block 930 can occur before, after, or simultaneously with block 920.

Method 900 can additionally include a block 940 for at least one of brazing, welding, or adhering the hosel insert within the hole. Block 940 can occur after or simultaneously with block 930.

In some examples, one or more of the different blocks of method 900 can be combined into a single block or performed simultaneously, and/or the sequence of such blocks can be changed. In the same or other examples, some of the blocks of method 900 can be subdivided into several sub-blocks. There can also be examples where method 900 can comprise further or different blocks. In addition, there can be examples where method 900 can comprise only part of the steps described above. For instance, block 940 can be optional in some implementations. Other variations can be implemented for method 900 without departing from the scope of the present disclosure.

Figure 10:
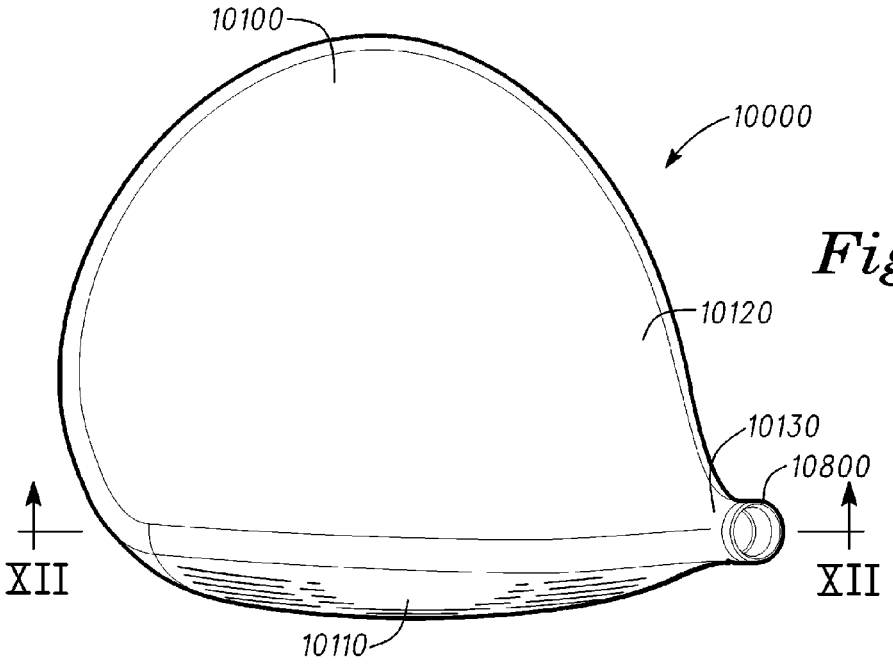
FIG. 10 illustrates a top view of a golf club head.
Figure 11:
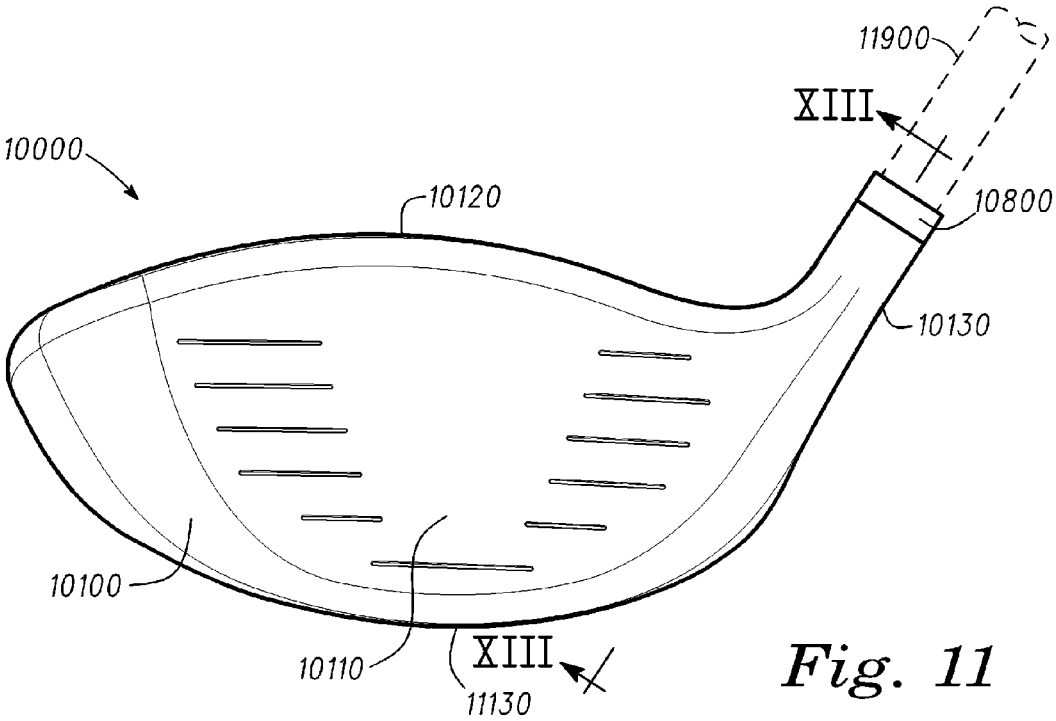
FIG. 11 is a front view of the golf club head of FIG. 10.
Figure 12:
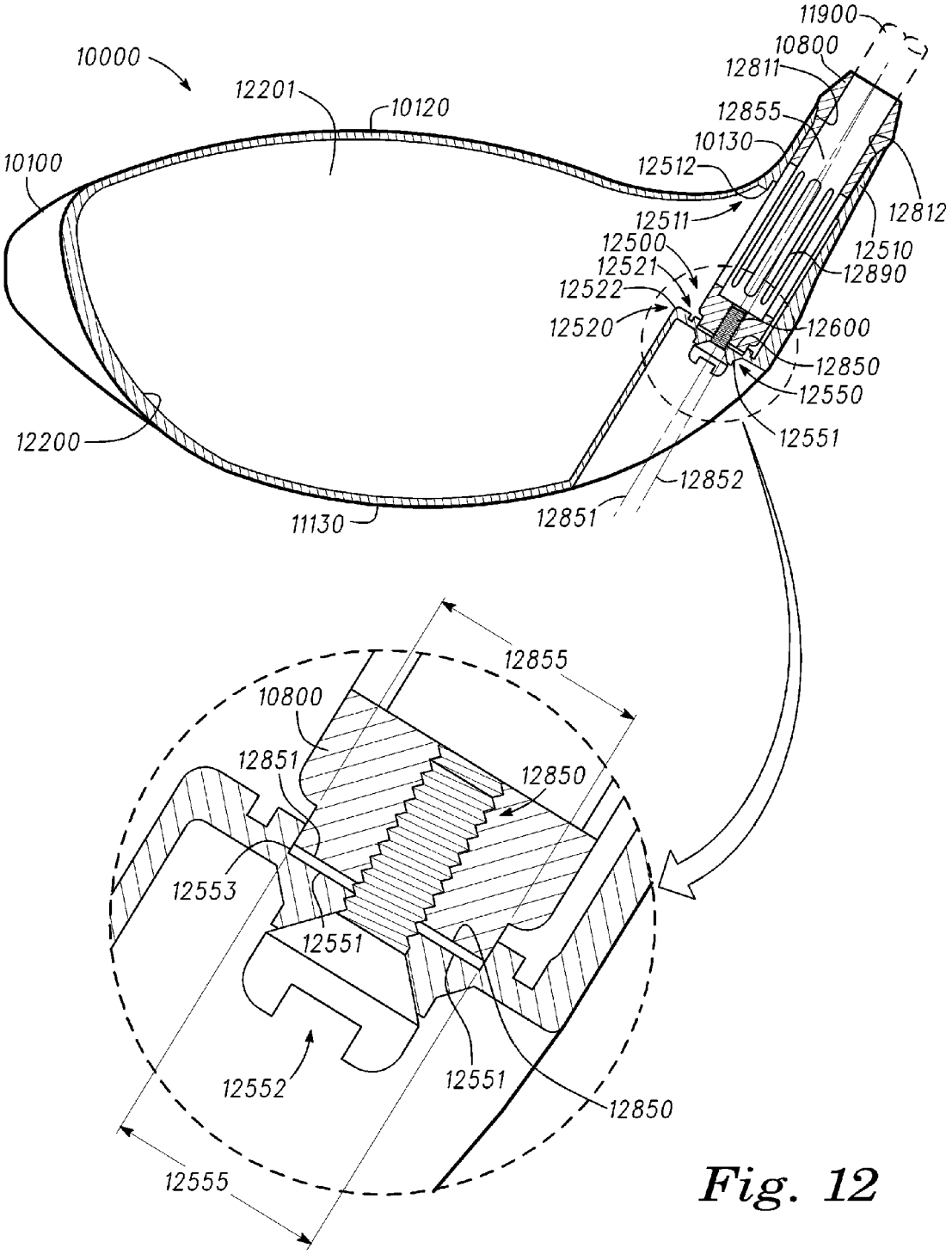
FIG. 12 is a front cross-sectional view of the golf club head of FIG. 10 along line XII-XII of FIG. 10, with a shaft sleeve fully seated in a receiver thereof
Figure 13:
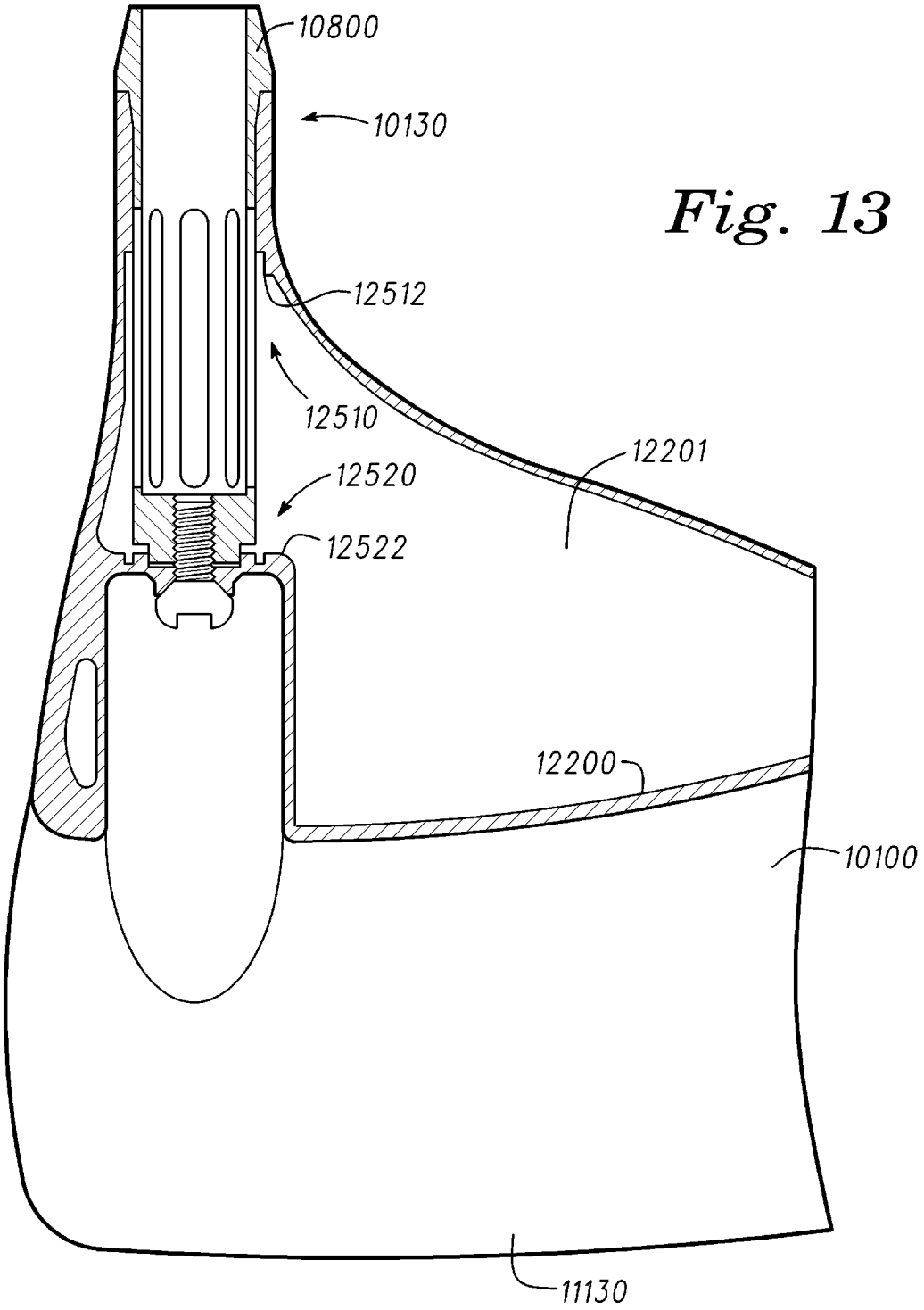
FIG. 13 is a heel cross-sectional view of the golf club head of FIG. 10 along line XIII-XIII of FIG. 11, with the shaft sleeve fully seated in the receiver.
Figure 14:
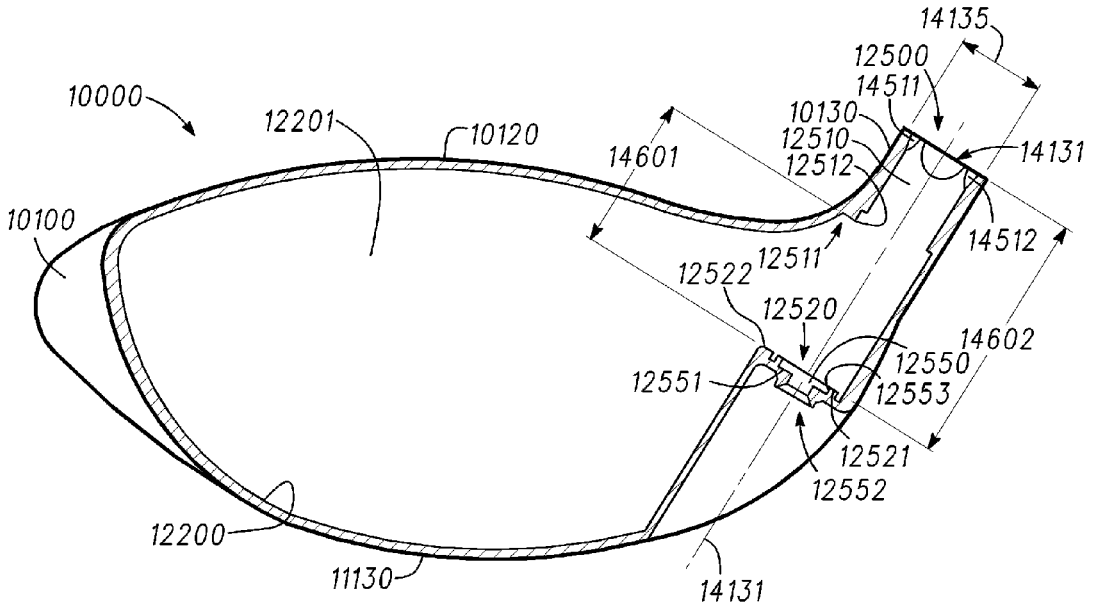
FIG. 14 is a front cross-sectional view of the golf club head of FIG. 10 along line XII-XII of FIG. 10, similar to the view of FIG. 12 but with the shaft sleeve removed.
Figure 15:
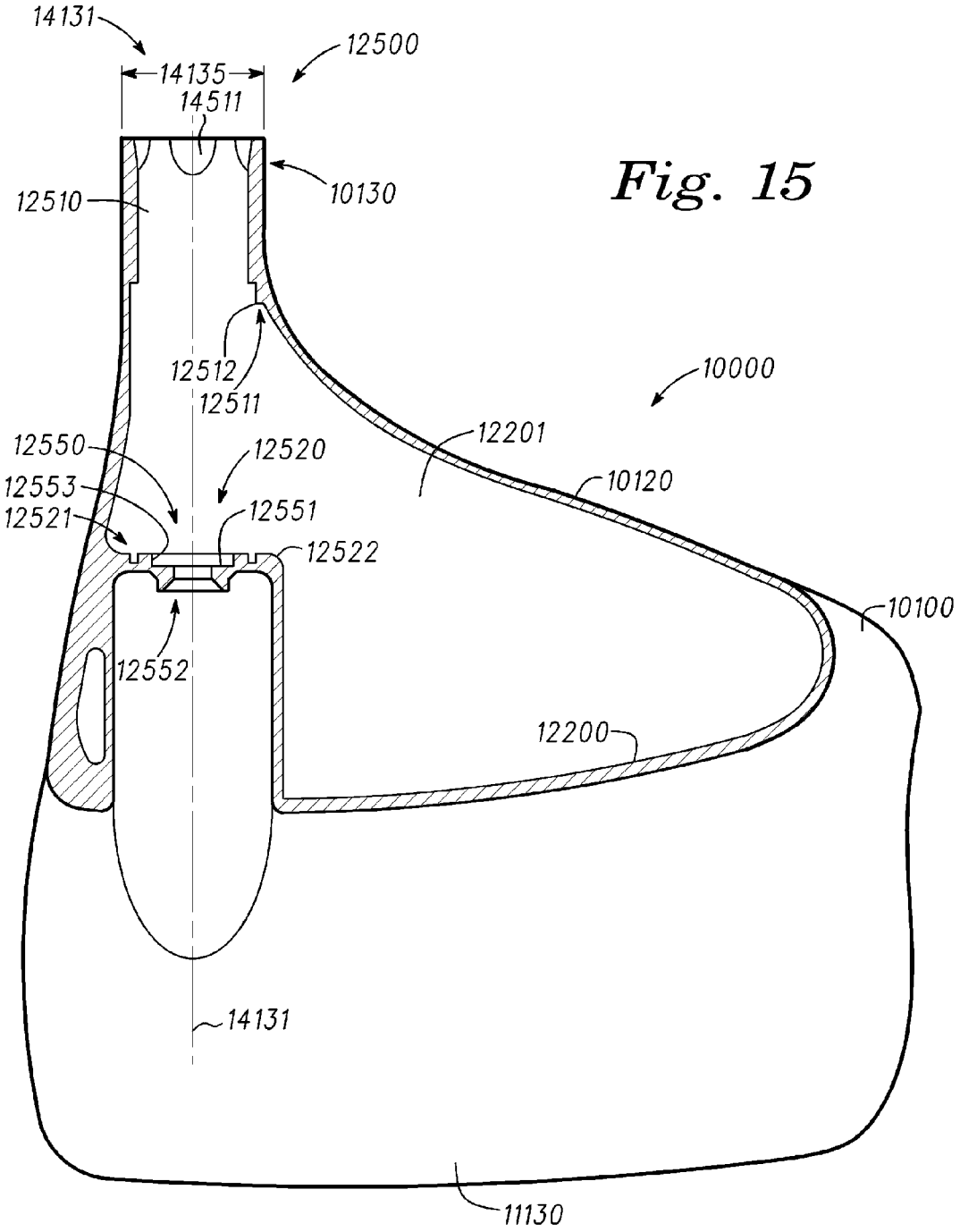
FIG. 15 is a heel cross-sectional view of the golf club head of FIG. 10 along line XIII-XIII of FIG. 11, similar to the view of FIG. 13 but with the shaft sleeve removed.

Moving on, FIG. 10 illustrates a top view of golf club head 10000, which can be similar to golf club head 100 (FIGS. 1-3), golf club head 500 (FIGS. 5-6), and/or golf club head 700 (FIGS. 7-8). FIG. 11 is a front view of golf club head 10000. FIG. 12 is a front cross-sectional view of golf club head 10000 along line XII-XII of FIG. 10, with shaft sleeve 10800 fully seated in receiver 12500 of golf club head 10000. FIG. 13 is a heel cross-sectional view of golf club head 10000 along line XIII-XIII of FIG. 11, with sleeve 10800 fully seated in receiver 12500. FIG. 14 is a front cross-sectional view of golf club head 10000 along line XII-XII of FIG. 10, similar to FIG. 12 but with sleeve 10800 removed. FIG. 15 is a heel cross-sectional view of golf club head 10000 along line XIII-XIII of FIG. 11, similar to FIG. 13 but with sleeve 10800 removed.

Sleeve 10800 is configured to be coupled at an end of golf club shaft 11900 (FIG. 11), such as to secure shaft 11900 to golf club head 10000. Sleeve 10800 can be similar to one or more of hosel insert 250 (FIG. 2-4), hosel insert 550 (FIGS. 5-6), and/or hosel insert 750 (FIGS. 7-8) in some examples. As seen in FIG. 12, sleeve bore axis 12852 is tilted relative to sleeve longitudinal axis 12851, where shaft 11900 is inserted into sleeve 10800 along sleeve bore axis 12852 of sleeve bore 12855, and where sleeve 10800 is inserted into receiver 12500 along hosel axis 14131 (FIGS. 14-15) such that sleeve longitudinal axis 12851 is collinear with hosel axis 14131. Accordingly, sleeve 10800 can position shaft 11900 to achieve different lie angle or loft angle combinations for golf club head 10000 depending on the orientation in which sleeve 10800 is inserted into receiver 12500. Shaft sleeve 10800 can comprise one or more voids through the bore wall of sleeve bore 12855, such as voids 12890 (FIGS. 12-13), that extend from sleeve bore 12855 to an exterior of shaft sleeve 10800. There can be other examples, however, where shaft sleeve 10800 need not comprise any voids 12890 or a different number or shape of voids 12890.

Golf club head 10000 comprises exterior head surface 10100, which includes strikeface 10110, exterior crown surface 10120 coupled to strikeface 10110, exterior sole surface 11130 coupled to strikeface 10110 and opposite exterior crown surface 11120, and exterior hosel surface 10130 located at a heel portion of crown surface 10120. Exterior hosel surface 10130 comprises top opening 14131 (FIGS. 14-15), which provides passage or access to interior head volume 12201 of golf club head 10000. Golf club head 10000 also comprises interior head surface 12200, which is opposite exterior head surface 10100 and defines interior head volume 12201 of golf club head 10000.

Golf club head 1000 also comprises receiver 12500 (FIGS. 12-15), which is located within interior head volume 12201, and which is configured to receive and secure shaft sleeve 10800 when shaft sleeve 10800 is inserted therein through top opening 14131 (FIGS. 12-13). In the present example, receiver 12500 comprises receiver hosel structure 12510 adjacent to top opening 14131 and is defined at least in part by interior head surface 12200 opposite exterior hosel surface 10130. Receiver 12500 also comprises receiver lower structure 12520, which is separated from receiver hosel structure 12510 and is located between exterior sole surface 11130 and receiver hosel structure 12510. In the present embodiment, receiver lower structure 12520 also is defined at least in part by interior head surface 12200.

As seen in FIG. 14-15, receiver hosel structure 12510 comprises one or more receiver couplers, such as receiver couplers 14511 and 14512 that are indented into interior head surface 12200 adjacent to top opening 14131. As seen in FIGS. 12-13, sleeve 10800 comprises one or more sleeve couplers protruding therefrom, such as sleeve couplers 12811 and 12812, that are complementary to the one or more sleeve couplers of sleeve 10800, and that are configured to mate with such one or more sleeve couplers of sleeve 10800 when sleeve 10800 is fully seated in receiver 12500 to prevent rotation of sleeve 10800 with respect to receiver 12500. For instance, when sleeve 10800 is fully seated in receiver 12500 as shown in FIGS. 12-13, sleeve coupler 12811 can be mated with receiver coupler 14511, and sleeve coupler 12812 can be mated with receiver coupler 14512, to prevent rotation of sleeve 10800 relative to receiver 12500. Receiver 12500 can accommodate sleeve 10800 in different orientations in some embodiments. For instance, sleeve 10800 could be rotated such that sleeve coupler 12811 mates with receiver coupler 14512 while sleeve coupler 12811 mates with receiver coupler 14512 when sleeve 10800 is fully seated in receiver 12500. In some implementations, such flexibility can permit sleeve 10800 to position shaft 11900 in different orientations to achieve different lie angle or loft angle combinations for golf club head 10000.

In the present example, the one or more receiver couplers of receiver hosel structure 12510, and the one or more sleeve couplers of sleeve 10800, each comprises a corresponding arcuate surface that is curved throughout its respective coupler surface area. Such an arrangement increases the surface area in contact between the receiver couplers of receiver hosel structure 12510 and the sleeve couplers of shaft sleeve 10800, thereby increasing the anti-rotation capabilities thereof. Accordingly, the size of the hosel structure can be minimized. For example, the size of hosel top end diameter 14135 (FIGS. 14-15) can be of less than or equal to approximately 15.2 mm (millimeters) in the present or other embodiments.

Receiver lower structure 12520 of receiver 12500 can be similar to support structure 225 (FIG. 2) or support structure 560 (FIGS. 5-6). In particular, as seen in FIGS. 12-16, top end 12521 of receiver lower structure 12520 is disconnected from receiver hosel structure 12510, being separated therefrom by a structural void therebetween. Accordingly, receiver 12500 is devoid of a duct that would otherwise connect receiver hosel structure 12510 to receiver lower structure 12520, thereby achieving weight and material savings that can, for example, be used to redistribute mass and/or adjust the center of gravity of golf club head 10000. In light of the above, in the present embodiment, at least a majority of the bottom half of sleeve 10800 is exposed to a majority of interior head volume 12201 when sleeve 10800 is fully seated in receiver 12500. For similar reasons, in the present example, a majority of a top surface or top end 12521 of receiver lower structure 12520 is exposed to a majority of interior head volume 12201, and the majority of top end 12521 of receiver lower structure 12520 is decoupled from the receiver hosel structure. In some examples, maximum distance 14601 (FIG. 14), measured parallel to hosel axis 14131 from bottom end 12511 of receiver hosel structure 12510 to top end 12521 of receiver lower structure 12520, can be up to approximately 25.4 mm. In the same or other examples, maximum distance 14602 (FIG. 14), measured parallel to hosel axis 14131 from top opening 14131 to top end 12521 of receiver lower structure 12520, can be up to approximately 38.1 mm.

Furthermore, in the present example, receiver lower structure 12520 comprises top perimeter 12522 that bounds top end 12521 thereof, and at least 25% of top perimeter 12522 of receiver lower structure 12520 is decoupled from bottom perimeter 12512 of receiver hosel structure 12510. As seen in FIG. 14, at least a toeward end of top perimeter 12522 of receiver lower structure 12520 is decoupled from a toeward end of bottom perimeter 12512 of receiver hosel structure 12510 by a structural void in interior head volume 12201. In some examples, however, a heelward end of top perimeter 12522 of receiver lower structure 12520 can be coupled to a heelward end of bottom perimeter 12512 of receiver hosel structure 12510 via a heelward end of interior head surface 12200 without departing from the scope of the present disclosure.

Receiver lower structure 12520 comprises receiver bottom coupler 12550 which, as seen in FIGS. 12-13, is complementary with sleeve bottom coupler 12850 of shaft sleeve 10800 and is configured to secure sleeve bottom coupler 12850 when shaft sleeve 10800 is fully seated in receiver 12500. For instance, when mated with sleeve bottom coupler 12550, receiver bottom coupler 12550 restricts at least a heel-to-toe displacement and/or a front-to-rear displacement of sleeve bottom coupler 12550 when shaft sleeve 10800 is secured in receiver 12500.

In the present embodiment, as seen in FIGS. 12-15, receiver bottom coupler 12550 is female, and comprises tub bottom surface 12551, where fastener passageway 12552 extends therethrough from interior head volume 12201 to exterior surface 10100 of golf club head 10000.

Fastener passageway 12552 is configured to couple with fastener 12600, where in the present example fastener 12600 comprises a screw with screw treads configured to engage a bottom end of shaft sleeve 10800 such as to pull shaft sleeve 10800 towards fastener passageway 12552. Thus, by pulling on shaft sleeve 10800, fastener 12600 secures the one or more complementary couplers of receiver hosel structure 12510 and of shaft sleeve 10800, such as receiver couplers 14511 and 14512 and sleeve couplers 12811 and 12812, against each other.

In some examples, hosel axis 14131 (FIGS. 14-15) can be defined by a top portion of exterior hosel surface 10130, and/or can extend through a center of top opening 14131 and through a center of fastener passageway 12552.

Receiver bottom coupler 12550 also comprises tub wall 12553 bounding tub bottom surface 12551, and tub diameter 12555 of tub bottom surface 12551 bounded by tub wall 12553. Sleeve bottom coupler 12850 is male in the present example, and comprises male coupler bottom surface 12851 and male coupler diameter 12855 of male coupler bottom surface 12851. As seen in FIGS. 12-13, tub diameter 12555 is complementary with male coupler diameter 12855, and is configured to accommodate male coupler diameter 12855 when shaft sleeve 10800 is fully seated in receiver 12500. Receiver 12500 is configured, however, such that tub surface 12551 remains separated from male coupler bottom surface 122851 when shaft sleeve 10800 is fully seated in receiver 12500. There can be other examples similar to the description above, however, but where receiver bottom coupler 12550 can be male and sleeve bottom coupler 12850 can be female.

As seen in FIGS. 12-13, the surface area of top end 12521 of receiver lower structure 12520 can be greater than the surface area of tub bottom surface 12551 of receiver bottom coupler 12550, thereby permitting greater flexibility for locating receiver bottom coupler 12550 at receiver lower structure 12520 within interior head volume 12201 depending on desired ranges for lie angles and/or loft angles afforded by receiver 12500 and shaft sleeve 10800.

Also in the preset example, tub bottom surface 12551 and male coupler bottom surface 12851 are each substantially flat and circular. Accordingly, receiver lower structure 12520 is devoid of one or more anti-rotation couplers with which to restrict a rotational movement of shaft sleeve 10800 when shaft sleeve 10800 is fully seated in the receiver. Instead, as described above, receiver 12500 relies on the one or more complementary couplers of receiver hosel structure 12510 and of shaft sleeve 10800 described above, such as receiver couplers 14511 and 14512 and sleeve couplers 12811 and 12812, to restrict such rotation of shaft sleeve 10800. By relying on receiver hosel structure 12510 to handle the anti-rotation features of receiver 12500, the formation of receiver lower structure 12520 and/or of tub bottom surface 12551 can be thus simplified by not having to provide anti-rotation coupler(s) thereat deep within interior volume 12201 of golf club head 10000. Thus, in some implementations, at least part of receiver bottom coupler 12550 can be formed via a rotary drill and/or a rotary cutter inserted through top opening 14131.

Figure 17:
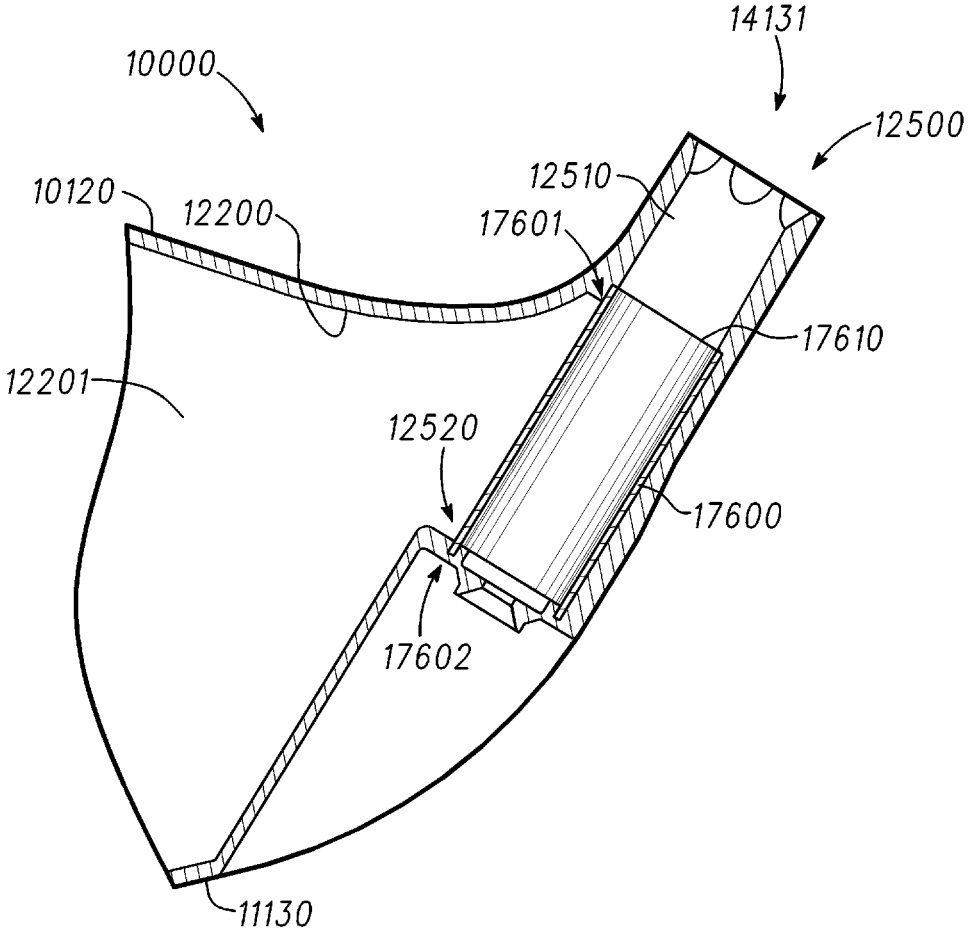
FIG. 17 illustrates a front cross-sectional view of a portion of the golf club head of FIG. 10, similar to the view of FIG. 14, but with a receiver sheath therein.

Skipping ahead in the figures, FIG. 17 illustrates a front cross-sectional view of a portion of golf club head 10000, similar to the view of FIG. 14, but with receiver sheath 17600 therein. As seen in FIG. 17, receiver sheath 17600 can be coupled with receiver 12500 to extend from receiver hosel structure 12510 to receiver lower structure 12520. In the present example, receiver sheath 17600 defines sheath passageway 17610 therethrough, where sheath passageway 17610 can be configured to accommodate insertion of at least a portion of sleeve 10800, and to permit shaft sleeve 10800 to fully seat at receiver 12500, when sleeve 10800 is inserted into receiver 12500 as described above with respect to FIGS. 12-13. As seen in FIG. 17, access via top opening 14131 to interior head volume 12201 is blocked when receiver sheath 17600 is coupled between receiver hosel structure 12510 and receiver lower structure 12520. Accordingly, receiver sheath 17600 can prevent entry of, for example, dirt or grass, into interior head volume 12201. In some examples, receiver sheath 17600 can comprise a sheath material different than a material of receiver 12500 and/or different than a material of other part(s) of golf club head 10000. For example, the sheath material can be different than the material of exterior hosel surface 10130. For example, the material of receiver 1250 and/or the material of exterior hosel surface 10130 can comprise a metallic material such as titanium, aluminum, steel, and/or alloy(s) thereof, and the sheath material of receiver sheath 17600 can comprise a plastic material and/or a composite material. In the same or other examples, receiver sheath 17600 can be flexible and/or decompressible. For instance, receiver sheath 17600 can be inserted into receiver 12500 via top opening 14131, and can then decompress or expand to engage one or more sheath coupler surfaces of receiver 12500, such as sheath coupler surface 17601 at receiver hosel structure 12510 and/or sheath coupler surface 17602 at receiver lower structure 12520.

Figure 16:
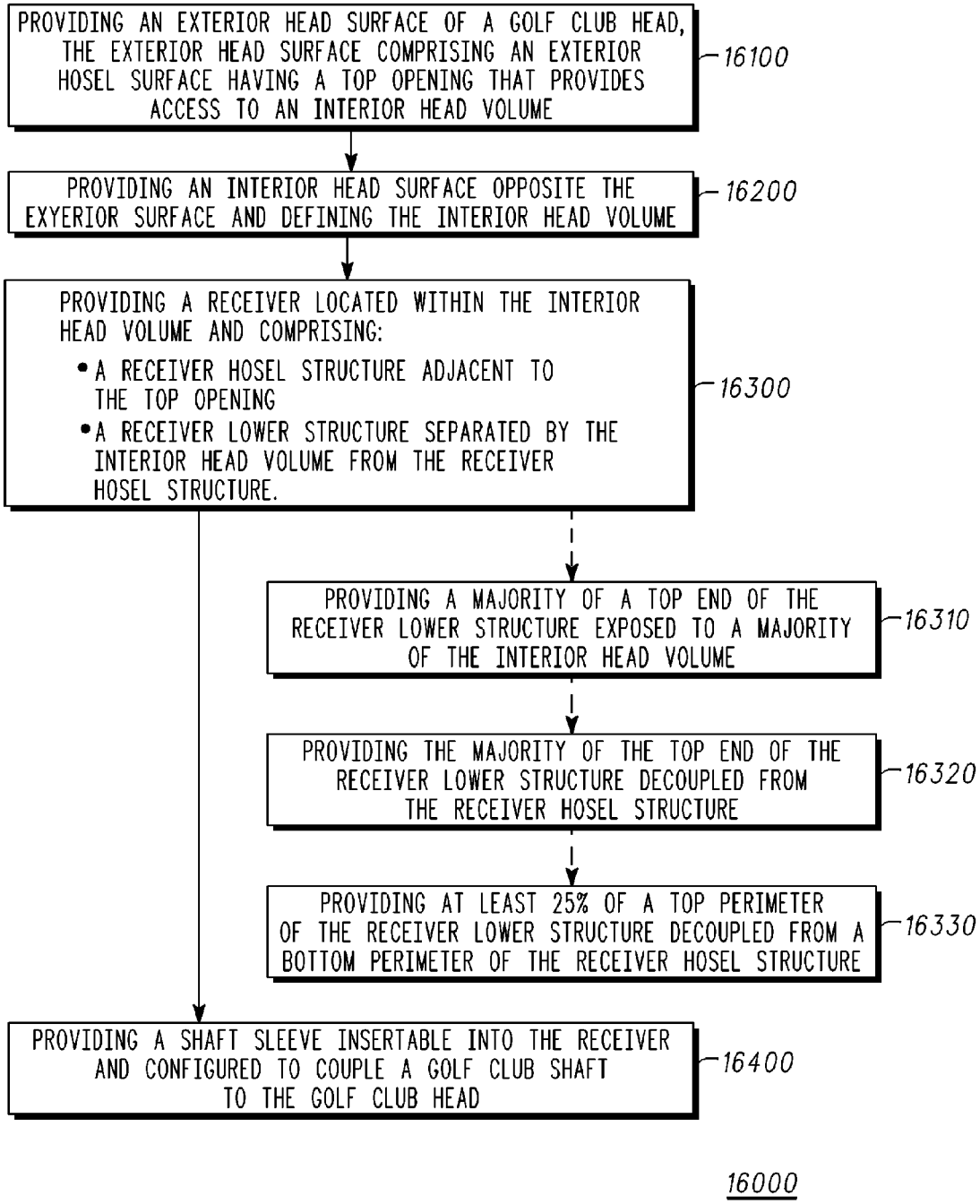
FIG. 16 illustrates a flowchart of a method for providing a golf club head.

Backtracking through the figures, FIG. 16 illustrates a flowchart of a method 16000 for providing a golf club head. In some examples, the golf club head can be similar to one or more of the golf club heads previously described, such as golf club head 10000 (FIGS. 10-15), and/or variations thereof.

Block 16100 of method 16000 comprises providing an exterior head surface of a golf club head, the exterior head surface comprising an exterior hosel surface having a top opening that provides access to an interior head volume. In some examples, the exterior head surface can be similar to exterior head surface 10100 of golf club head 10000 (FIGS. 10-15). In the same or other examples, the exterior hosel surface, the top opening, and the interior head volume can be respectively similar to exterior hosel surface 10130 (FIGS. 10-15), top opening 14131 (FIGS. 14-15), and interior head volume 12201 (FIGS. 10-15).

Block 16200 of method 16000 comprises providing an interior head surface opposite the exterior head surface and defining the interior head volume. In some examples, the interior head surface can be similar to interior head surface 12200 (FIGS. 12-15) defining interior head volume 12201.

Block 16300 of method 16000 comprises providing a receiver located within the interior head volume and comprising (a) a receiver hosel structure adjacent to the top opening and (b) a receiver lower structure separated by the interior head volume from the receiver hosel structure. The receiver can be similar to receiver 12500 (FIGS. 12-15) in some implementations. In the same or other examples, the receiver hosel structure can be similar to receiver hosel structure 12510 (FIGS. 12-15), and/or the receiver lower structure can be similar to receiver lower structure 12520 (FIGS. 12-15).

In some implementations, block 16300 can comprise sub-block 16310 for providing a majority of a top end of the receiver lower structure exposed to a majority of the interior head volume. In some examples, the top end of the receiver lower structure can be accordingly exposed as described for and/or as shown by FIGS. 12-15 with respect to the majority of top end 12521 of receiver lower structure 12520 exposed to the majority of interior head volume 12201.

In the same or other implementations, block 16300 can comprise sub-block 16320 for providing the majority of the top end of the receiver lower structure decoupled from the receiver hosel structure. In some examples, the majority of the top end of the receiver lower structure can be decoupled from the receiver hosel structure as described for and/or as shown by FIGS. 12-15 with respect to top end 12521 of receiver lower structure 12520 decoupled from receiver hosel structure 12510.

In the same or other implementations, block 16300 can comprise sub-block 16330 for providing at least 25% of a top perimeter of the receiver lower structure decoupled from a bottom perimeter of the receiver hosel structure. In some examples, the top perimeter of the receiver lower structure can be decoupled from the bottom perimeter of the receiver hosel structure as described for and/or as shown by FIGS. 12-15 with respect to top perimeter 12522 of receiver lower structure 12520 decoupled from receiver hosel structure 12510.

Method 16000 can also comprise block 16400 for providing a shaft sleeve insertable into the receiver and configured to couple a golf club shaft to the golf club head. In some examples, the shaft sleeve can be similar to shaft sleeve 10800 (FIGS. 10-13), and/or the golf club shaft can be similar to golf club shaft 11900 (FIGS. 11-12).

There can be examples where different blocks of method 16000 can be combined into a single block or performed simultaneously, and/or where the sequence of such blocks can be changed. For instance, blocks 16100, 16200, and/or 16300 and/or any sub-blocks thereof can be carried out simultaneously, in some examples. There can also be examples where method 16000 can comprise further or different blocks. As an example, method 16000 can comprise another block for coupling a golf club shaft to the shaft sleeve of block 16400. In addition, some of the blocks of method 16000 can be optional. For instance, one or more of block 16400, sub-block 16310, sub-block 16320, and/or sub-block 16330 can be optional in some implementations. Other variations can be implemented for method 16000 without departing from the scope of the present disclosure.

Although the golf club heads with hosel inserts and related methods have been described with reference to specific embodiments, various changes may be made without departing from the scope of the present disclosure. As an example, different features of hosel inserts 250 (FIGS. 2-4), 550 (FIG. 5), 750 (FIGS. 7-8), and/or of shaft sleeve 10800 (FIGS. 10-12) can be combined together in other hosel inserts. As another example, there can be embodiments where receiver bottom coupler 12550 and sleeve bottom coupler 12850 (FIGS. 12-15) can comprise complementary anti-rotation couplers configured to restrict rotation of shaft sleeve 10800. Other examples and other variations have been given in the foregoing description. Other permutations of the different embodiments having one or more of the features of the various figures are likewise contemplated. Accordingly, the specification, claims, and drawings herein are intended to be illustrative of the scope of the disclosure and are not intended to be limiting. It is intended that the scope of shall be limited only to the extent required by the appended claims.

The golf club heads with hosel inserts and related methods discussed herein may be implemented in a variety of embodiments, and the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

Similarly, all elements claimed in any particular claim are essential to the embodiment claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a wood-type golf club, the apparatus, methods, and articles of manufacture described herein may be applicable to other types of golf club such as a hybrid-type golf club, an iron-type golf club, a wedge-type golf club, and/or a putter-type golf club. In other embodiments, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

The invention claimed is:

1. A golf club head comprising:

an exterior head surface comprising:

a strike face;

an exterior crown surface coupled to the strike face, the exterior crown surface comprising an exterior hosel surface, and the exterior hosel surface comprising a top opening that provides access to an interior head volume of the golf club head; and an exterior sole surface coupled to the strike face and opposite the exterior crown surface;

an interior head surface opposite the exterior head surface and defining the interior head volume;

a receiver located within the interior head volume and comprising:

a receiver hosel structure adjacent to the top opening and defined at least in part by the interior head surface opposite the exterior hosel surface; and a receiver lower structure separated by the interior head volume from the receiver hosel structure;

and a shaft sleeve comprising a sleeve bottom coupler;

wherein:

the receiver lower structure comprises a receiver bottom coupler that is complementary with the sleeve bottom coupler and that is configured to secure the sleeve bottom coupler when the shaft sleeve is seated in the receiver;

one of the sleeve bottom coupler or the receiver bottom coupler comprises:

a female coupler comprising:

a tub bottom surface; and a tub wall bounding the tub bottom surface; and a tub diameter of the tub bottom surface bounded by the tub wall;

a different one of the sleeve bottom coupler or the receiver bottom coupler comprises:

a male coupler comprising:

a male coupler bottom surface; and a male coupler diameter of the male coupler bottom surface;

when the shaft sleeve is fully seated in the receiver:

the tub diameter complementarily accommodates the male coupler diameter; and the tub bottom surface remains separated from the male coupler bottom surface;

a majority of a top end of the receiver lower structure is exposed to a majority of the interior head volume; and the majority of the top end of the receiver lower structure is decoupled from the receiver hosel structure.

2. The golf club head of claim 1, wherein:

the receiver lower structure is defined at least in part by the interior head surface.

3. The golf club head of claim 1, wherein:

the shaft sleeve further comprises a first sleeve coupler;

the receiver hosel structure comprises a first receiver coupler adjacent to the top opening; and the first receiver coupler is complementary to, and configured to mate with, the first sleeve coupler when the shaft sleeve is fully seated in the receiver.

4. The golf club head of claim 1, wherein:

the receiver is configured to receive the shaft sleeve through the top opening; and when the shaft sleeve is fully seated in the receiver, a majority of a bottom half of the shaft sleeve is exposed to the interior head volume of the golf club head.

5. The golf club head of claim 1, wherein:

the receiver bottom coupler is configured to restrict a heel-to-toe direction displacement of the sleeve bottom coupler when the shaft sleeve is secured in the receiver.

6. The golf club head of claim 1, wherein:

the receiver lower structure is devoid of one or more anti-rotation couplers with which to restrict a rotational movement of the shaft sleeve when the shaft sleeve is fully seated in the receiver.

7. The golf club head of claim 1, wherein:

the tub bottom surface is substantially flat and circular; and the male coupler bottom surface is substantially flat and circular.

8. The golf club head of claim 1, wherein:

a surface area of the top end of the receiver lower structure is greater than a surface area of the tub bottom surface bounded by the tub wall.

9. The golf club head of claim 1, wherein:

the exterior hosel surface comprises a hosel top end bounding the top opening; and the hosel top end comprises a hosel top diameter less than or equal to 15.2 mm.

10. The golf club head of claim 1, wherein:

a maximum distance from a bottom end of the receiver hosel structure to the top end of the receiver lower structure is up to approximately 25.4 mm.

11. The golf club head of claim 1, wherein:

a maximum distance from the top opening to the top end of the receiver lower structure is up to approximately 38.1 mm.

12. The golf club head of claim 1, further comprising:

a fastener configured to be received by the receiver lower structure.

13. A golf club head comprising:

an exterior head surface comprising:

a strike face;

an exterior crown surface coupled to the strike face, the exterior crown surface comprising an exterior hosel surface, and the exterior hosel surface comprising a top opening that provides access to an interior head volume of the golf club head; and an exterior sole surface coupled to the strike face and opposite the exterior crown surface;

an interior head surface opposite the exterior head surface and defining the interior head volume;

a receiver located within the interior head volume and comprising:

a receiver hosel structure adjacent to the top opening and defined at least in part by the interior head surface opposite the exterior hosel surface; and a receiver lower structure separated by the interior head volume from the receiver hosel structure;

and the shaft sleeve;

wherein:

the receiver lower structure comprises:

a receiver bottom coupler bounded by the top perimeter of the receiver lower structure;

the receiver bottom coupler is complementary with a sleeve bottom coupler of a shaft sleeve and configured to secure the sleeve bottom coupler when the shaft sleeve is seated in the receiver;

the receiver hosel structure comprises a first receiver coupler adjacent to the top opening;

the shaft sleeve comprises a first sleeve coupler complementary to the first receiver coupler of the receiver hosel structure;

when the shaft sleeve is fully seated in the receiver, the first receiver coupler engages the first sleeve coupler to restrict a rotation of the shaft sleeve;

an arcuate surface of the first sleeve coupler is curved throughout an entire surface area of the first sleeve coupler;

an arcuate surface of the first receiver coupler is curved throughout an entire surface area of the first receiver coupler; and at least 25% of a top perimeter of the receiver lower structure is decoupled from a bottom perimeter of the receiver hosel structure.

14. The golf club head of claim 13, wherein:

a top end of the receiver lower structure is bounded by the top perimeter and separated from the receiver hosel structure by a structural void in the interior head volume.

15. The golf club head of claim 13, further wherein:

the shaft sleeve comprises a bore and a bore wall bounding the bore; and the bore wall comprises one or more voids therethrough extending from the bore to an exterior of the shaft sleeve.

16. The golf club head of claim 13, wherein:
the receiver lower structure comprises a fastener passageway that extends to the interior head volume through the interior and exterior head surfaces;
the exterior hosel surface defines a hosel axis about which the exterior hosel surface is centered; and
the hosel axis extends through a center of the fastener passageway and a center of the top opening.

17. The golf club head of claim 13, wherein:
the first receiver coupler is configured to mate with the first sleeve coupler when the shaft sleeve is fully seated in the receiver.

18. The golf club head of claim 13, wherein:
the exterior hosel surface comprises a hosel top end bounding the top opening; and
the hosel top end comprises a hosel top diameter less than or equal to 15.2 mm.

19. The golf club head of claim 13, wherein:
the receiver comprises a receiver material; and
the receiver is devoid of an internal duct that:
extends from the receiver hosel structure to the receiver lower structure; and
comprises the receiver material.

20. The golf club head of claim 13, wherein:
a top surface of the receiver lower structure is bounded by the top perimeter and exposed to a majority of the interior head volume.

21. The golf club head of claim 13, wherein:
at least one of:
a maximum distance from a bottom end of the receiver hosel structure to a top end of the receiver lower structure is up to approximately 25.4 mm; or
a maximum distance from the top opening to a top end of the receiver lower structure is up to approximately 38.1 mm.

22. The golf club head of claim 13, wherein:
at least a toeward end of the top perimeter of the receiver lower structure is decoupled from a toeward end of the bottom perimeter of the receiver hosel structure by a structural void in the interior head volume.

23. The golf club head of claim 13, wherein:
a heelward end of the top perimeter of the receiver lower structure is coupled to a heelward end of the bottom perimeter of the receiver hosel structure via the interior head surface.

24. The golf club head of claim 13, further comprising:
a receiver sheath extended from the receiver hosel structure to the receiver lower structure;
wherein:
the receiver sheath defines a sheath passageway configured to accommodate insertion of at least a portion of the shaft sleeve therethrough;
access via the top opening to the interior head volume outside the sheath passageway is blocked by the receiver sheath;
the receiver sheath comprises a sheath material; and
a density of a material of the receiver is greater than a density of the sheath material.

25. A method for providing a golf club head comprising:
providing an exterior head surface comprising:
a strike face;
an exterior crown surface coupled to the strike face, the exterior crown surface comprising an exterior hosel surface, and the exterior hosel surface comprising a top opening that provides access to an interior head volume of the golf club head; and
an exterior sole surface coupled to the strike face and opposite the exterior crown surface;
providing an interior head surface opposite the exterior head surface and defining the interior head volume;
providing a receiver located within the interior head volume and comprising:
a receiver hosel structure adjacent to the top opening and defined at least in part by the interior head surface opposite the exterior hosel surface; and
a receiver lower structure separated by the interior head volume from the receiver hosel structure;
and
providing a shaft sleeve comprising a sleeve bottom coupler;
wherein:
the receiver lower structure comprises a receiver bottom coupler that is complementary with the sleeve bottom coupler and that is configured to secure the sleeve bottom coupler when the shaft sleeve is seated in the receiver;
one of the sleeve bottom coupler or the receiver bottom coupler comprises:
a female coupler comprising:
a tub bottom surface; and
a tub wall bounding the tub bottom surface; and
a tub diameter of the tub bottom surface bounded by the tub wall;
a different one of the sleeve bottom coupler or the receiver bottom coupler comprises:
a male coupler comprising:
a male coupler bottom surface; and
a male coupler diameter of the male coupler bottom surface;
when the shaft sleeve is fully seated in the receiver:
the tub diameter complementarily accommodates the male coupler diameter; and
the tub bottom surface remains separated from the male coupler bottom surface;
providing the receiver comprises:
providing a majority of a top end of the receiver lower structure exposed to the interior head volume; and
providing the majority of the top end of the receiver lower structure decoupled from the receiver hosel structure.

* * * * *